US008451391B2

(12) United States Patent
Ueki et al.

(10) Patent No.: US 8,451,391 B2
(45) Date of Patent: May 28, 2013

(54) LIQUID CRYSTAL DISPLAY DEVICE ACHIEVING PREDETERMINED COLOR TEMPERATURE WHILE PREVENTING A SHIFT IN COLOR TONE BY CORRECTING BLUE LUMINANCE

(75) Inventors: Shun Ueki, Nara (JP); Kozo Nakamura, Nara (JP); Akiko Miyazaki, Kyoto (JP); Tokio Taguchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 167 days.

(21) Appl. No.: 12/442,733

(22) PCT Filed: Sep. 20, 2007

(86) PCT No.: PCT/JP2007/068275

§ 371 (c)(1), (2), (4) Date: Apr. 16, 2009

(87) PCT Pub. No.: WO2008/038568

PCT Pub. Date: Apr. 3, 2008

(65) Prior Publication Data

US 2010/0091032 A1 Apr. 15, 2010

(30) Foreign Application Priority Data

Sep. 26, 2006 (JP) ..... 2006-261410

(51) Int. Cl.
*G09G 5/04* (2006.01)

(52) U.S. Cl.
USPC ..... 349/33; 345/590

(58) Field of Classification Search
USPC ..... 345/590; 349/106–109
See application file for complete search history.

(56) References Cited

U.S. PATENT DOCUMENTS

| | | | |
|---|---|---|---|
| 4,800,375 | A | 1/1989 | Silverstein et al. |
| 6,300,931 | B1 | 10/2001 | Someya et al. |
| 6,856,364 | B2 | 2/2005 | Yamashita et al. |
| 6,859,243 | B2 | 2/2005 | Yamashita et al. |

(Continued)

FOREIGN PATENT DOCUMENTS

| | | |
|---|---|---|
| EP | 0 915 363 A2 | 5/1999 |
| EP | 1 679 677 A1 | 7/2006 |

(Continued)

OTHER PUBLICATIONS

International Preliminary Report on Patentability with Written Opinion (English Translation) of PCT/JP2007/068275 dated Mar. 31, 2009.*

(Continued)

*Primary Examiner* — Mark Robinson
*Assistant Examiner* — Andrew Jordan
(74) *Attorney, Agent, or Firm* — Keating & Bennett, LLP

(57) ABSTRACT

A liquid crystal display device includes a liquid crystal display panel having a pixel defined by at least three sub-pixels including a blue sub-pixel, a backlight which emits, toward the liquid crystal display panel, light that brings a color temperature to a predetermined level when the pixel displays white, and a color tone correction circuit which corrects a color tone of a color displayed by the pixel. When the pixel displays a color containing at least one predetermined color component that is other than a white component and a blue component, the color tone correction circuit performs a correction to set a luminance of the blue sub-pixel lower than an original luminance.

21 Claims, 18 Drawing Sheets

U.S. PATENT DOCUMENTS

| | | | | |
|---|---|---|---|---|
| 6,862,012 | B1 * | 3/2005 | Funakoshi et al. | 345/88 |
| 7,643,094 | B2 | 1/2010 | Kawashima et al. | |
| 2002/0063666 | A1 | 5/2002 | Kang et al. | |
| 2003/0020736 | A1 | 1/2003 | Kimura et al. | |
| 2004/0174389 | A1 * | 9/2004 | Ben-David et al. | 345/694 |
| 2005/0122294 | A1 | 6/2005 | Ben-David et al. | |
| 2005/0200580 | A1 * | 9/2005 | Li et al. | 345/88 |
| 2005/0206979 | A1 | 9/2005 | Tomizawa et al. | |
| 2006/0209004 | A1 | 9/2006 | Nagai et al. | |
| 2009/0009664 | A1 | 1/2009 | Kawashima et al. | |
| 2009/0052773 | A1 | 2/2009 | Oohara | |
| 2011/0242149 | A1 * | 10/2011 | Yoshida et al. | 345/690 |

FOREIGN PATENT DOCUMENTS

| | | | |
|---|---|---|---|
| JP | 09-251160 | A | 9/1997 |
| JP | 2001-209047 | A | 8/2001 |
| JP | 2001-306023 | A | 11/2001 |
| JP | 2002-140038 | A | 5/2002 |
| JP | 2004-109572 | A | 4/2004 |
| JP | 2007-110432 | A | 4/2007 |
| WO | 02/101644 | A2 | 12/2002 |
| WO | 2005/043501 | A1 | 5/2005 |
| WO | 2005/104084 | A2 | 11/2005 |
| WO | 2006/095496 | A1 | 9/2006 |

OTHER PUBLICATIONS

Official Communication issued in International Patent Application No. PCT/JP2007/068275, mailed on Oct. 23, 2007.

Ueki et al.; "Display"; U.S. Appl. No. 12/088,887, filed Apr. 1, 2008.

"Broadcasting Technology Series 2: Broadcasting Formats", Japan Broadcast Publishing Co., Ltd., Jan. 20, 1983, pp. 130-132.

Yang et al., "Development of Six Primary-Color LCD", SID 05 Digest, May 25-27, 2005, pp. 1210-1213.

Chino et al., "Development of Wide-Color-Gamut Mobile Displays With Four-Primary-Color LCDS", SID 06 Digest, Jun. 7-9, 2006, pp. 1221-1224.

Ben-Chorin, "Improving LCD TV Color Using Multi-Primary Technology", Genoa Color Technologies, Flat Panel Display, International 2005 Forum, Oct. 19, 2005, pp. 1-53.

Official Communication issued in corresponding European Patent Application No. 07807639.5, mailed on Sep. 10, 2009.

Official Communication issued in International Patent Application No. PCT/JP2007/068275, mailed on Apr. 9, 2009.

* cited by examiner

FIG. 9A
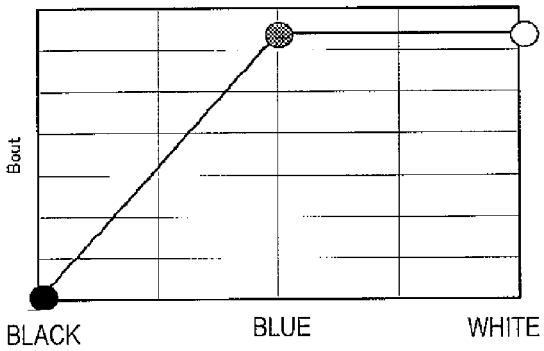
FIG. 9C
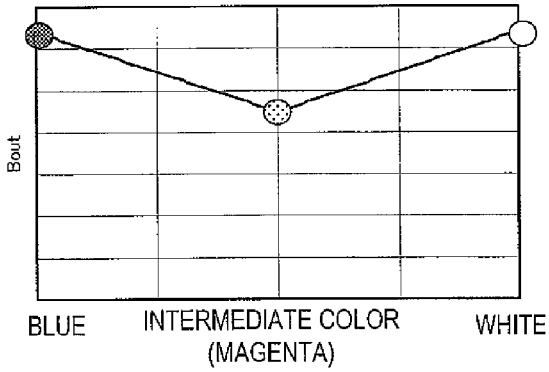
FIG. 9B
| | | | | | | | | | |
|---|---|---|---|---|---|---|---|---|---|
| Rin | 0 | → | 0 | ↗ | 255 | 0 | ↗ | 255 | → | 255 |
| Gin | 0 | → | 0 | ↗ | 255 | 0 | → | 0 | ↗ | 255 |
| Bin | 0 | ↗ | 255 | → | 255 | 255 | → | 255 | → | 255 |
| b COM-PONENT | 0 | ↗ | 255 | ↘ | 0 | 255 | ↘ | 0 | → | 0 |
| w COM-PONENT | 0 | → | 0 | ↗ | 255 | 0 | → | 0 | ↗ | 255 |
| m COM-PONENT | 0 | → | 0 | → | 0 | 0 | ↗ | 255 | ↘ | 0 |
FIG. 9D

LIQUID CRYSTAL DISPLAY DEVICE ACHIEVING PREDETERMINED COLOR TEMPERATURE WHILE PREVENTING A SHIFT IN COLOR TONE BY CORRECTING BLUE LUMINANCE

BACKGROUND OF THE INVENTION

1. Field of the Invention

The present invention relates to a liquid crystal display device, and more specifically, to a liquid crystal display device that includes a backlight.

2. Description of the Related Art

Color display devices such as color television sets and color monitors usually express colors by additive color mixing of primary colors, R, G, and B (red, green, and blue). In color liquid crystal display devices, each pixel has a red sub-pixel, a green sub-pixel, and a blue sub-pixel which correspond to the primary colors R, G, and B, respectively. The luminances of the red, green, and blue sub-pixels are varied to express a diversity of colors. The red, green, and blue sub-pixels are realized by forming three sub-pixel regions within a single pixel region in a color filter.

Backlights in conventional liquid crystal display devices have a spectrum as the one illustrated in FIG. 31, and color filter elements which correspond to sub-pixels in conventional liquid crystal display devices have transmittances such as the ones illustrated in FIG. 32. In FIG. 32, R, G, and B represent, respectively, transmittances at which color filter elements of red, green, and blue sub-pixels transmit light of varying wavelengths. Liquid crystal display devices display an image (or the like) using light of a given spectrum that is emitted from a backlight, modulated in sub-pixels, and passes through a color filter.

FIG. 33 schematically illustrates a gamut of reproducible colors in a conventional liquid crystal display device. In FIG. 33, R, G, B, Ye, C, M, and W represent, respectively, red, green, blue, yellow, cyan, magenta, and white displayed by a pixel. Red, green, and blue correspond to sub-pixels of the liquid crystal display device and are also called primary colors. Yellow, cyan, and magenta are intermediate colors of the primary colors. The reproducible color gamut is shown as a vectorial sum of vectors to red, green, and blue with black (not shown) as reference, and white is at the center of the vectorial sum. The chromaticity of white is equal to that of black in FIG. 33 for the sake of simplification. A color within the reproducible color gamut may be displayed by setting the luminances of red, green, and blue sub-pixels to arbitrary values.

FIG. 34 illustrates chromaticities at which a pixel displays red (R), green (G), blue (B), yellow (Ye), cyan (C), magenta (M), and white (W) in a conventional liquid crystal display device. As illustrated in Table 1, the conventional liquid crystal display device has a reproducible color gamut that is 69% when measured by NTSC ratio, and has a color temperature of 6,600 K.

TABLE 1

| NTSC ratio | Color temperature |
|---|---|
| 69% | 6,600 K |

The color temperature is 6,600 K in the conventional liquid crystal display device described with reference to FIGS. 31 and 32. A higher color temperature is desired in some cases. For instance, while the standard color temperature according to NTSC is about 6,500 K, the Japanese generally prefer a high color temperature and color television sets for the Japanese market are set to 9,300 K (see, for example, Japan Broadcast Publishing Co., Ltd., "Broadcasting Technology Series 2: Broadcasting Formats" 1st Ed., Japan, Jan. 20, 1983, pp. 130-132). A high color temperature liquid crystal display device may be realized by using a backlight that is high in color temperature, namely, a backlight that is high in intensity in the short wavelength region of the visible light spectrum (see, for example, JP 2001-228322 A).

As disclosed in JP 2001-228322 A, a predetermined color temperature may be realized by using a given backlight. However, the inventors of the present application have discovered that simply switching to a given backlight shifts the color tone and accordingly lowers the display quality.

Specifically, in a three-primary color liquid crystal display device, simply employing a backlight that is high in intensity in the short wavelength region (hereinafter, referred to as "high color temperature backlight") shifts the color tone and accordingly lowers the display quality as mentioned above.

Multi-primary color liquid crystal display devices have also been proposed in which yellow sub-pixels are added to red, green, and blue sub-pixels in order to expand the reproducible color gamut. If a multi-primary color liquid crystal display device uses the same backlight as in a three-primary color liquid crystal display device, the additional yellow sub-pixels give a displayed color a yellowish overtone, which makes the color temperature lower than in a three-primary color liquid crystal display device. A multi-color liquid crystal display device therefore needs to use a backlight that is high in intensity in the short wavelength region (i.e., high color temperature backlight) in order to achieve a color temperature equivalent to that of a three-primary color liquid crystal display device. In this case, too, simply employing a high color temperature backlight shifts the color tone and lowers the display quality.

SUMMARY OF THE INVENTION

In view of the above-mentioned problems, preferred embodiments of the present invention provide a liquid crystal display device that achieves a predetermined color temperature while preventing a shift in color tone.

According to a preferred embodiment of the present invention, a liquid crystal display device includes: a liquid crystal display panel which includes a pixel defined by at least three sub-pixels including a blue sub-pixel; a backlight which emits, toward the liquid crystal display panel, light that brings a color temperature to a predetermined level when the pixel displays white; and a color tone correction section which corrects a color tone of a color displayed by the pixel, in which, when the pixel displays a color containing at least one predetermined color component that is other than a white component and a blue component, the color tone correction section makes a correction to set a luminance of the blue sub-pixel lower than an original luminance.

In one preferred embodiment, the at least one predetermined color component is a magenta component or a cyan component.

In one preferred embodiment, when the pixel displays a color that contains only the blue component, a color that contains only the white component, or a color that contains only the white component and the blue component, the color tone correction section makes a correction to set the luminance of the blue sub-pixel lower than the original luminance.

In one preferred embodiment, when the pixel displays a color that contains only the blue component, a color that contains only the white component, or a color that contains only the white component and the blue component, the color tone correction section does not make a correction on the luminance of the blue sub-pixel and the luminance of the blue sub-pixel is equal to the original luminance.

In one preferred embodiment, a maximum luminance of the blue sub-pixel that is set when the pixel displays an arbitrary color containing the at least one predetermined color component is lower than the luminance of the blue sub-pixel that is set when the pixel displays at least one of white and blue.

In one preferred embodiment, the color tone correction section creates a corrected image signal that indicates luminances to be actually presented by the at least three sub-pixels, from an image signal that indicates original luminances of a red sub-pixel, a green sub-pixel, and the blue sub-pixel in a pixel that is formed only of the red sub-pixel, the green sub-pixel, and the blue sub-pixel.

In one preferred embodiment, the color tone correction section includes: a color component extracting unit which extracts a color component from a color of the pixel that is indicated by the image signal; and a signal synthesizing unit which, based on the original luminance of the blue sub-pixel and the color component, creates the corrected image signal in a manner that makes the luminance to be actually presented by the blue sub-pixel lower than the original luminance.

In one preferred embodiment, the at least three sub-pixels include a red sub-pixel and a green sub-pixel.

In one preferred embodiment, the at least three sub-pixels further include a yellow sub-pixel.

In one preferred embodiment, the color tone correction section sets a luminance of the yellow sub-pixel to a predetermined value.

In one preferred embodiment, when the pixel displays a color which is free of a yellow component and which contains at least one color component other than the yellow component, the color tone correction section makes a correction to set the luminance of the blue sub-pixel lower than the original luminance.

In one preferred embodiment, the at least three sub-pixels further include a cyan sub-pixel.

In one preferred embodiment, when the pixel displays a color which is free of the yellow component and a cyan component and which contains at least one color component other than the yellow component and the cyan component, the color tone correction section makes a correction to set the luminance of the blue sub-pixel lower than the original luminance.

According to various preferred embodiments of the present invention, a liquid crystal display device includes a pixel that is defined by at least three sub-pixels including a blue sub-pixel, in which a maximum luminance of the blue sub-pixel that is set when the pixel displays an arbitrary color containing at least one predetermined color component that is other than a white component and a blue component is lower than a luminance of the blue sub-pixel that is set when the pixel displays at least one of white and blue.

In one preferred embodiment, the at least one predetermined color component is a magenta component or a cyan component.

In one preferred embodiment, the at least three sub-pixels include a red sub-pixel and a green sub-pixel.

In one preferred embodiment, the at least three sub-pixels further include a yellow sub-pixel.

In one preferred embodiment, the at least three sub-pixels further include a cyan sub-pixel.

According to various preferred embodiments of the present invention, a liquid crystal display device includes a pixel containing a red sub-pixel, a green sub-pixel, and a blue sub-pixel, in which a luminance of the blue sub-pixel that is set when the pixel displays magenta and a luminance of the blue sub-pixel that is set when the pixel displays cyan are lower than a luminance of the blue sub-pixel that is set when the pixel displays white.

In one preferred embodiment, the pixel further includes a yellow sub-pixel.

In one preferred embodiment, the pixel further includes a cyan sub-pixel.

According to various preferred embodiments of the present invention, a liquid crystal display device that achieves a predetermined color temperature while preventing a shift in color tone may be provided.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 9A is a graph illustrating a change in luminance of the blue sub-pixel indicated by a corrected image signal that is observed when the pixel color changes from black to blue and then to white in the liquid crystal display device of the first preferred embodiment of the present invention, FIG. 9B illustrates, in a manner parallel to the change in FIG. 9A, changes in Rin, Gin, Bin, b component, w component, and m component that are indicated by an image signal, FIG. 9C is a graph illustrating a change in luminance of the blue sub-pixel indicated by a corrected image signal that is observed when the color of the pixel changes from blue to an intermediate color (magenta, for example) and then to white, and FIG. 9D illustrates, in a manner parallel to the change in FIG. 9C, changes in Rin, Gin, Bin, b component, w component, and m component that are indicated by an image signal.

DETAILED DESCRIPTION OF THE PREFERRED EMBODIMENTS

First Preferred Embodiment

A liquid crystal display device of a first preferred embodiment according to the present invention is described below with reference to the drawings.

Figure 1:
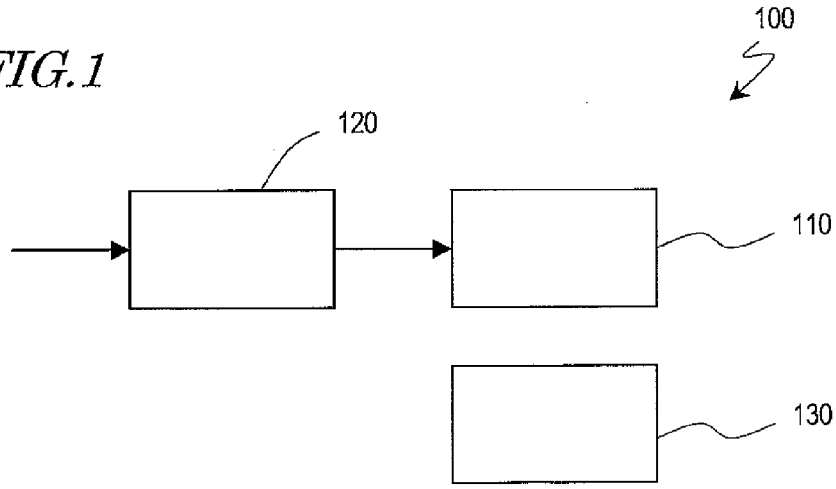
FIG. 1 is a schematic diagram illustrating a liquid crystal display device of a first preferred embodiment according to the present invention.
Figure 2:
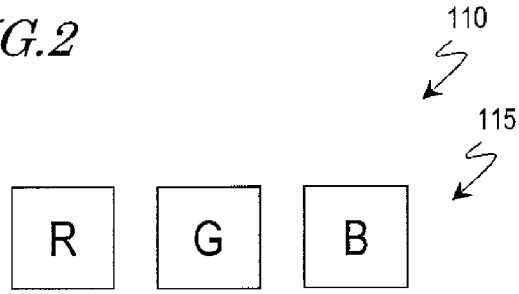
FIG. 2 is a schematic diagram illustrating a single pixel in the liquid crystal display device of the first preferred embodiment of the present invention.

As illustrated in FIG. 1, a liquid crystal display device 100 of this preferred embodiment includes a liquid crystal display panel 110, which has pixels each defined by three sub-pixels, a color tone correction circuit 120, which corrects a color tone of a color displayed by a pixel, and a backlight 130, which emits, toward the liquid crystal display panel 110, light that brings a color temperature to a predetermined level when a pixel displays white. One pixel 115 in the liquid crystal display panel 110 has three sub-pixels, specifically, a red sub-pixel (R), a green sub-pixel (G), and a blue sub-pixel (B) as illustrated in FIG. 2. The red, green, and blue sub-pixels are realized by forming three sub-pixel regions within a single pixel region in a color filter (not shown). As illustrated in FIG. 2, the red, green, and blue sub-pixels have equal areas.

Figure 3:
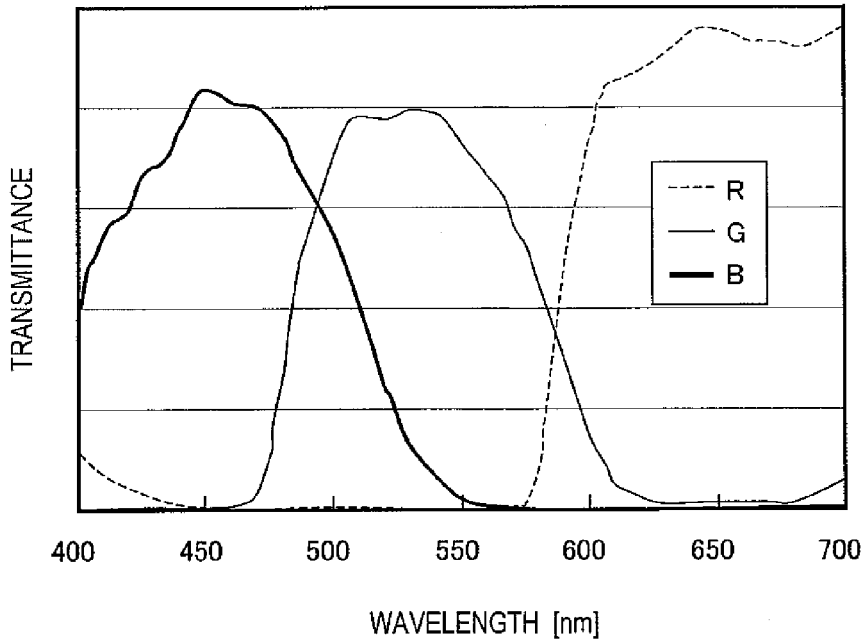
FIG. 3 is a graph illustrating transmittances of color filter elements which correspond to sub-pixels in the liquid crystal display device of the first preferred embodiment of the present invention.
Figure 32:
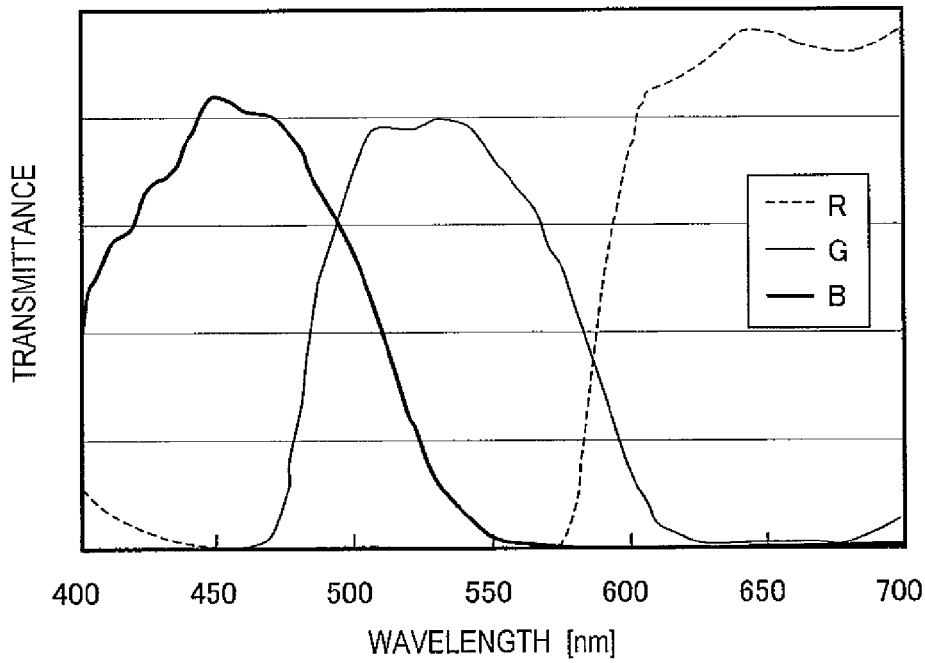
FIG. 32 PRIOR ART
FIG. 32 is a graph illustrating the transmittances of color filter elements which correspond to sub-pixels in a conventional liquid crystal display device.

FIG. 3 illustrates transmittances of color filter elements which correspond to the sub-pixels in the liquid crystal display device 100. In FIG. 3, R, G, and B represent, respectively, transmittances at which color filter elements of red, green, and blue sub-pixels transmit light of varying wavelengths. The color filter elements in the liquid crystal display device 100 have the same transmittances as in a conventional liquid crystal display device of FIG. 32.

Figure 4:
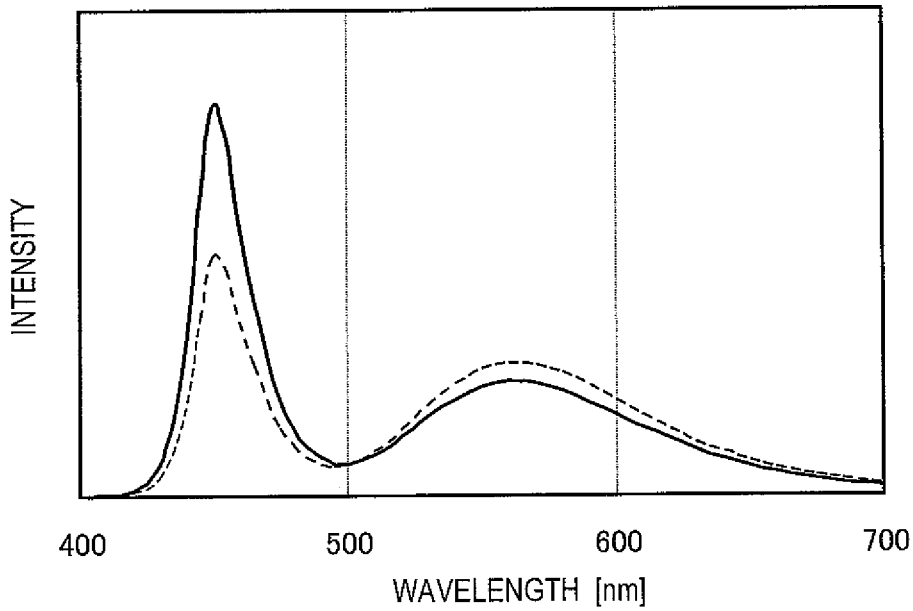
FIG. 4 is a graph illustrating spectra of backlights in a conventional liquid crystal display device and the liquid crystal display device of the first preferred embodiment of the present invention.
Figure 31:
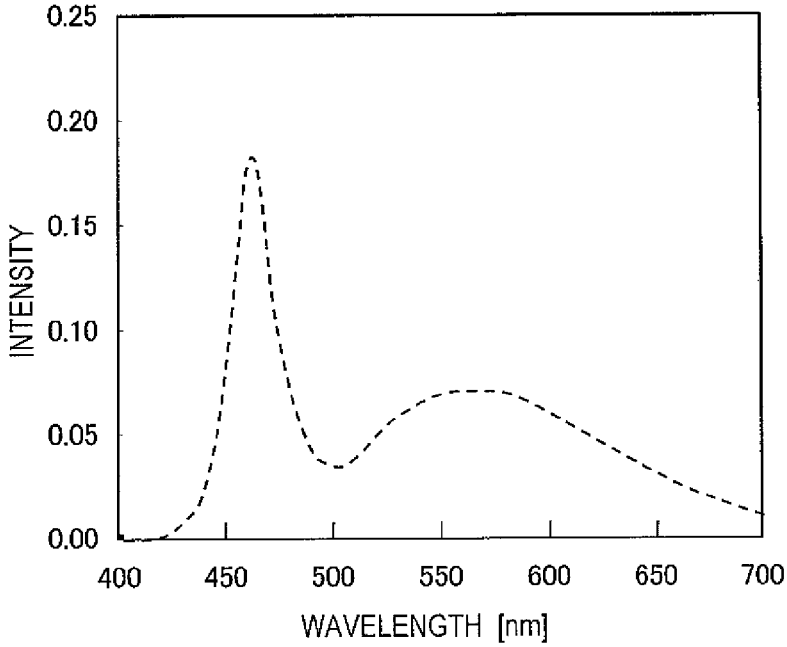
FIG. 31 PRIOR ART
FIG. 31 is a graph illustrating a spectrum of a backlight in a conventional liquid crystal display device.

The liquid crystal display device 100 uses a high color temperature backlight as the backlight 130. FIG. 4 illustrates in solid line a spectrum of the high color temperature backlight 130 in the liquid crystal display device 100 and, for reference, illustrates in broken line a spectrum of a backlight in the conventional liquid crystal display device, which is illustrated in FIG. 31. The backlight 130 uses a light emitting diode (LED). As may be seen in FIG. 4, compared to the backlight in the conventional liquid crystal display device, the spectrum of the high color temperature backlight 130 is high in intensity at a wavelength that corresponds to blue and low in intensity at wavelengths that correspond to red and green. This spectrum change is accomplished by reducing an amount of a yellow-light emitting fluorescent material which absorbs blue light and emits yellow light. In the liquid crystal display device 100 which has a different backlight spectrum than that of the conventional liquid crystal display device as described above, a color displayed by a pixel assumes a more bluish overtone than in the conventional liquid crystal display device, and a high color temperature is thus achieved. The term color temperature used in the following description means, unless otherwise stated, a color temperature that is registered when a liquid crystal display device displays "white". Further, a backlight in a conventional liquid crystal display device is called a conventional backlight in the following description.

The liquid crystal display device of this preferred embodiment is outlined below in comparison with a liquid crystal display device of Comparative Example 1. First, the liquid crystal display device of Comparative Example 1 is described. The liquid crystal display device of Comparative Example 1 uses the same type of high color temperature backlight as the backlight 130 of the liquid crystal display device 100. The liquid crystal display device of Comparative Example 1 also has the same transmittances of color filter elements as the ones in the liquid crystal display device 100 of this preferred embodiment which are illustrated in FIG. 4. The liquid crystal display device of Comparative Example 1 differs from the liquid crystal display device 100 of this preferred embodiment in that the color tone correction circuit 120 is not provided.

Figure 5:
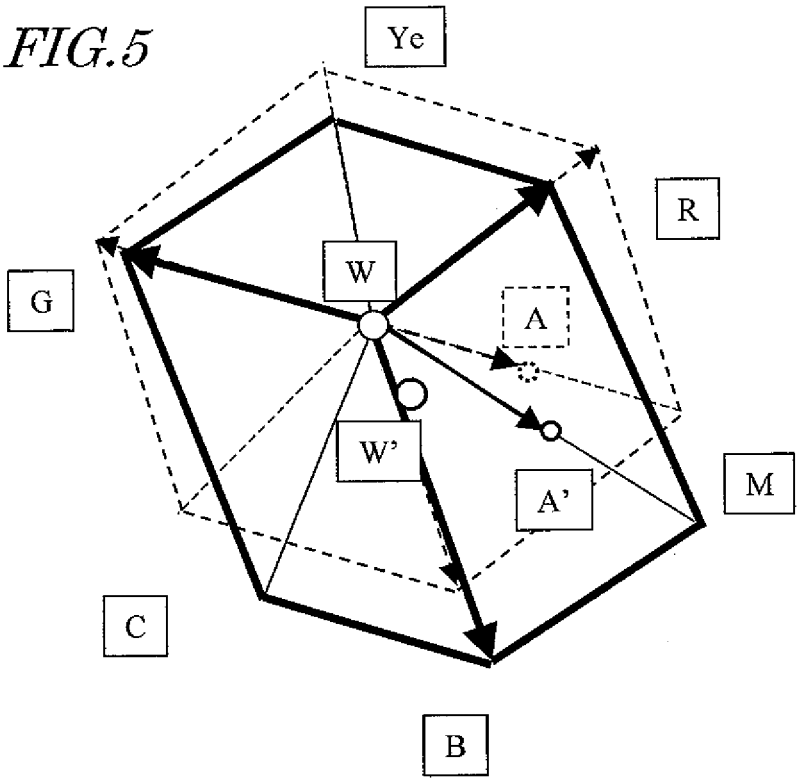
FIG. 5 is a schematic diagram for describing a reproducible color gamut in a liquid crystal display device of Comparative Example 1.
Figure 33:
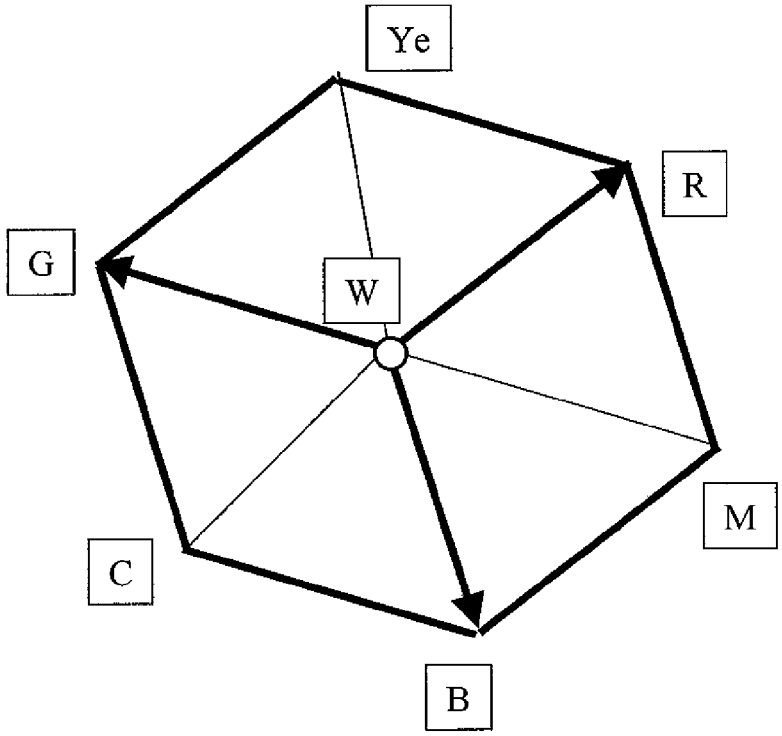
FIG. 33 PRIOR ART
FIG. 33 is a schematic diagram illustrating a reproducible color gamut in a conventional liquid crystal display device.
Figure 34:
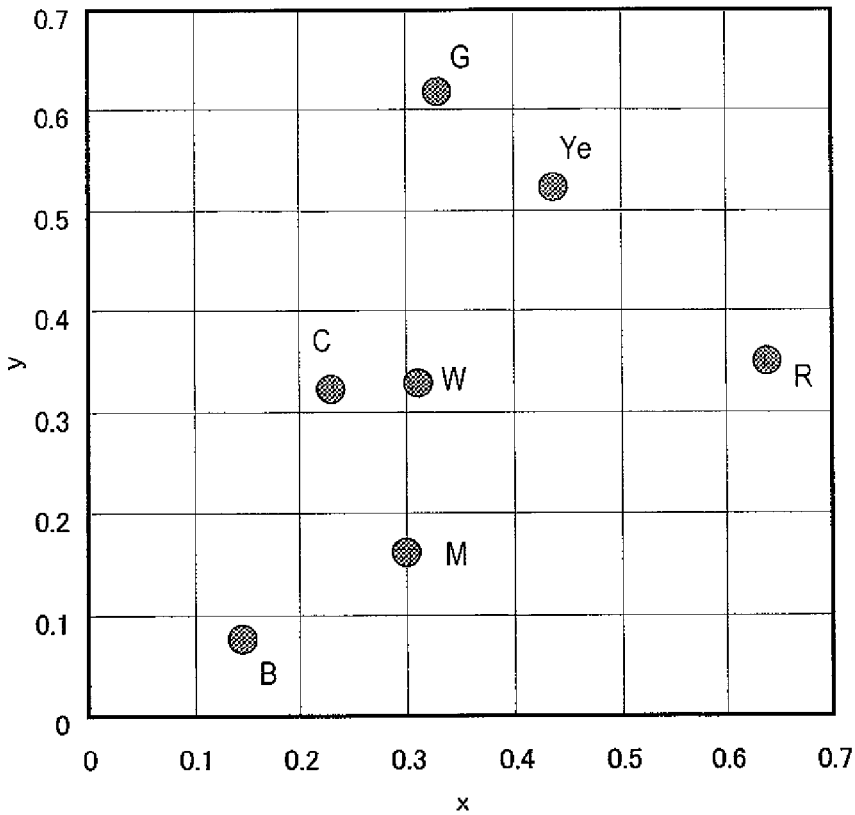
FIG. 34 PRIOR ART
FIG. 34 is a graph illustrating chromaticities at which a pixel displays red (R), green (G), blue (B), yellow (Ye), cyan (C), magenta (M), and white (W) in a conventional liquid crystal display device.

In FIG. 5, a reproducible color gamut of the liquid crystal display device of Comparative Example 1 is illustrated in solid line and, for reference, a reproducible color gamut of the conventional liquid crystal display device, which is illustrated in FIG. 33, is illustrated in broken line. FIG. 5 places black in the liquid crystal display device of Comparative Example 1 in the same position as that of black in the conventional liquid crystal display device because a color saturation of black is low.

The spectrum of the high color temperature backlight used in the liquid crystal display device of Comparative Example 1 is high in intensity at a wavelength that corresponds to blue and low in intensity at wavelengths that correspond to red and green, which makes a vector in a blue direction long and vectors in red and green directions short. In the liquid crystal display device of Comparative Example 1, white W' which is expressed by a vectorial sum of the red, green, and blue vectors is accordingly shifted in the blue direction from white W in the conventional liquid crystal display device and, similarly, the reproducible color gamut is shifted in the blue direction from the reproducible color gamut of the conventional liquid crystal display device.

Now, consider a case in which the maximum luminance of each sub-pixel is 256, and the liquid crystal display devices of the conventional art and Comparative Example 1 display magenta at an intermediate luminance with the luminances of the R, G, and B sub-pixels set to (R, G, B)=(127, 0, 127). In FIG. 5, A represents the color displayed by the conventional liquid crystal display device, and A' represents the color displayed by the liquid crystal display device of Comparative Example 1. As may be understood from FIG. 5, the chromaticity of A' in the liquid crystal display device of Comparative Example 1 greatly differs from that of A in the conventional liquid crystal display device and is shifted in the blue direction. FIG. 5 illustrates a color tone shift observed when magenta is displayed, but the color tone shifts in a similar manner also when it is cyan that is displayed. Using a high color temperature backlight in the liquid crystal display device of Comparative Example 1 thus shifts the color tone in the blue direction and hinders proper displaying.

Figure 6:
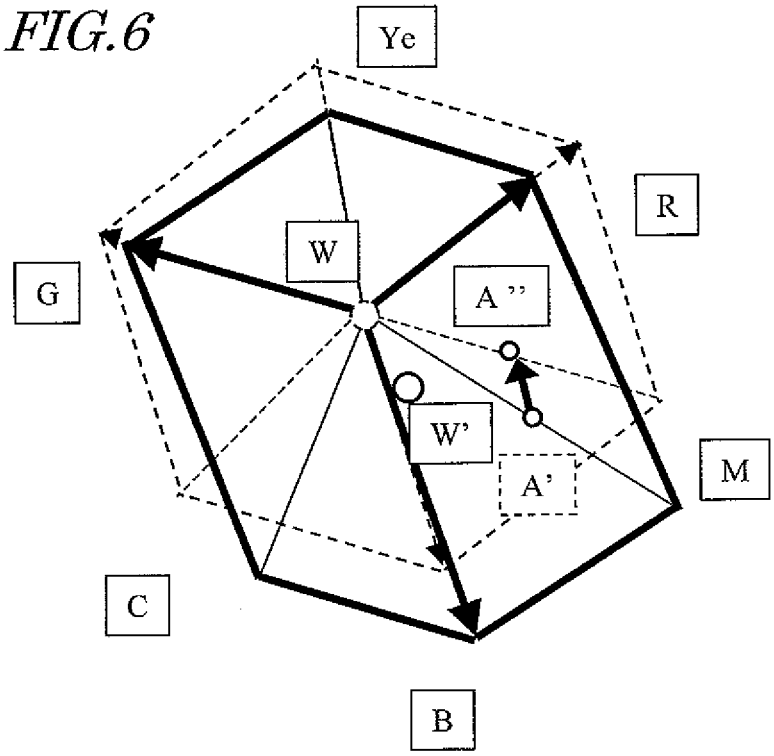
FIG. 6 is a schematic diagram illustrating that a shift in color tone is suppressed in the liquid crystal display device of the first preferred embodiment of the present invention.

Next, the liquid crystal display device of this preferred embodiment is described with reference to FIGS. 1 and 6. The liquid crystal display device 100 of this embodiment has the color tone correction circuit 120 as illustrated in FIG. 1. The color tone correction circuit 120 creates, for example, from an image signal which indicates the original luminances of the red, green, and blue sub-pixels, a corrected image signal which indicates luminances that the red, green, and blue sub-pixels should actually present. The luminance of the blue sub-pixel is thus made lower than its original luminance. The image signal may be, for example, input to the color tone correction circuit 120 or created in the color tone correction circuit 120. If the original luminance of the blue sub-pixel that is indicated by the image signal is given as Bin and a luminance to be actually presented by the blue sub-pixel (may simply be referred to as "blue sub-pixel luminance") which is indicated by the corrected image signal is given as Bout, the color tone correction circuit 120 makes a correction in a manner that sets Bout lower than Bin.

For instance, when the image signal indicates that the original luminances of the R, G, and B sub-pixels are (R, G, B)=(127, 0, 127), the color tone correction circuit 120 corrects the image signal so that the blue sub-pixel luminance is, for example, 0.7 times the original luminance thereof, and thus creates the corrected image signal that indicates that the luminances of the R, G, and B sub-pixels are (R, G, B)=(127, 0, 89). This changes the color displayed by the pixel in the liquid crystal display device 100 to A" as illustrated in FIG. 6, thus enabling the liquid crystal display device 100 of this preferred embodiment to display a color that has approximately the same chromaticity as that of the color A displayed by the conventional liquid crystal display device. Owing to a correction made by the color tone correction circuit 120 in the above-mentioned manner in which the blue sub-pixel luminance is set lower than its original luminance, a shift in color tone resulting from the use of a high color temperature backlight may be suppressed.

The color tone correction circuit 120 corrects the luminance of the blue sub-pixel based on the image signal. The color tone correction circuit 120 first extracts color components of a pixel color indicated by the image signal. Color components are r (red), g (green), b (blue), ye (yellow), c (cyan), m (magenta), and w (white). The w component is a component whose presence is common to the luminances of the red, green, and blue sub-pixels. Strictly speaking, the w component is a component that represents an achromatic color of the same chromaticity as white and, herein, is also called a white component. The ye component is a component whose presence is common to the luminances of the red and green sub-pixels. The c component is a component whose presence is common to the luminances of the green and blue sub-pixels. The m component is a component whose presence is common to the luminances of the red and blue sub-pixels. The r, g, and b components are components that remain after removing the w, ye, c, and m components from the color components of a pixel color, and that correspond to the luminances of the red, green, and blue sub-pixels, respectively. The color tone correction circuit 120 determines whether to correct the luminance of the blue sub-pixel based on the original luminance of the blue sub-pixel and the color components.

Bout correction by the color tone correction circuit 120 is described below with reference to Table 2.

TABLE 2

| | Bin > 0 | Presence of other color components than b component and w component | Need to correct Bout |
|---|---|---|---|
| Case 1 | Yes | Yes | Yes |
| Case 2 | Yes | No | No |
| Case 3 | No | Yes | No |

As may be understood from Table 2, Bout is corrected when the situation matches Case 1, specifically, when Bin>0 is satisfied and other components than the b component and the w component, namely, any of the r, g, ye, c, and m components is present. Though not illustrated in Table 2, when Bin=0 and no other components than the b component and the w component are present, Rin, Gin, and Bin are all zero and Bout is not corrected.

Concrete examples of when the color tone correction circuit 120 corrects Bout are described below with reference to FIGS. 7A to 7F. Here, the original luminances of the red, green, and blue sub-pixels which are indicated by the image signal are denoted by Rin, Gin, and Bin, respectively, whereas the luminances of the red, green, and blue sub-pixels that are indicated by the corrected image signal are denoted by Rout, Gout, and Bout, respectively. Rout and Gout are equal to Rin and Gin, respectively. Bout is corrected when the situation matches Case 1, and is not corrected when Case 2 or Case 3 applies. The luminances of each sub-pixel varies within a range between the minimum luminance (which corresponds to, for example, the lowest gray scale level 0) of the sub-pixel and the maximum luminance (which corresponds to, for example, the highest gray scale level 255) of the sub-pixel and, here, the luminances of the respective sub-pixels are expressed in a relative manner.

Figure 7A:
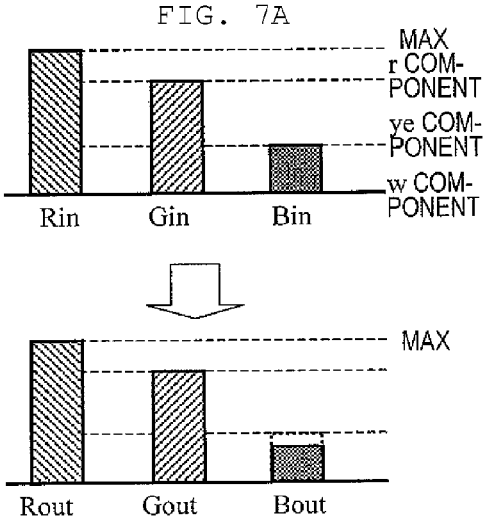
FIGS. 7A to 7F are schematic diagrams each illustrating a relation between luminances of sub-pixels that are indicated by an image signal and luminances of the sub-pixels that are indicated by a corrected image signal in the liquid crystal display device of the first preferred embodiment of the present invention.

As illustrated in FIG. 7A, when Rin>Gin>Bin>0, the smallest of the values of Rin, Gin, and Bin (namely, value of Bin) is regarded as the w component and, of Rin−Bin, which is a subtraction of this smallest value from Rin, and Gin−Bin, which is a subtraction of this smallest value from Gin, the smaller one (namely, value of Gin−Bin) is regarded as the ye component. Rin−Gin is regarded as the r component. In this case, Bin>0 is satisfied and the r component and the ye component are present as other components than the b component and the w component. The situation therefore matches Case 1 and the color tone correction circuit 120 corrects Bout.

Figure 7B:
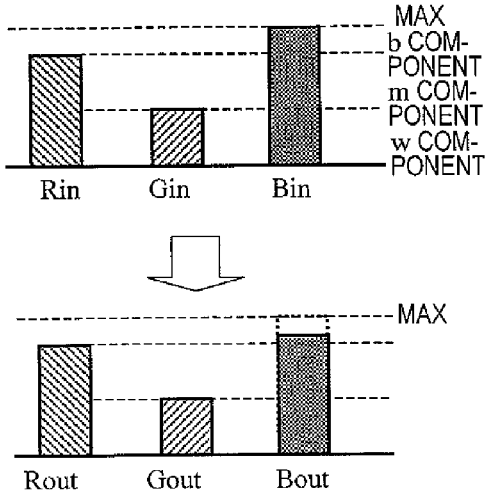

As illustrated in FIG. 7B, when Bin>Rin>Gin>0, the smallest of the values of Rin, Gin, and Bin (namely, value of Gin) is regarded as the w component and, of Rin−Gin, which is a subtraction of this smallest value from Rin, and Bin−Gin, which is a subtraction of this smallest value from Bin, the smaller one (namely, value of Rin−Gin) is regarded as the m component. Bin−Rin is regarded as the b component. In this case, Bin>0 is satisfied and the m component is present as an additional component to the b component and the w component. The situation therefore matches Case 1 and the color tone correction circuit 120 corrects Bout.

Figure 7C:
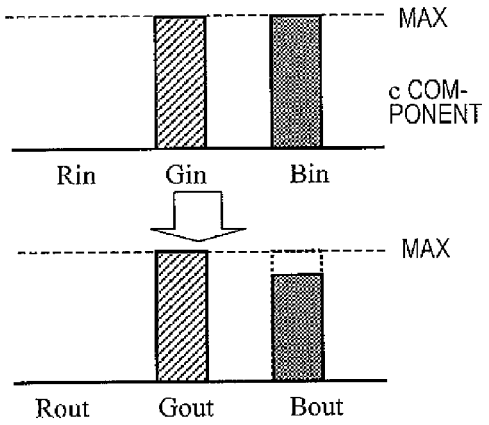

As illustrated in FIG. 7C, when Gin=Bin=Max (for example, 255) and Rin=0, in other words, when a pixel is to display cyan, Gin and Bin have the same value and this value of Gin or Bin is regarded as the c component. In this case, Bin>0 is satisfied and the c component is present as an additional component to the b component and the w component. The situation therefore matches Case 1 and the color tone correction circuit 120 corrects Bout.

Figure 7D:
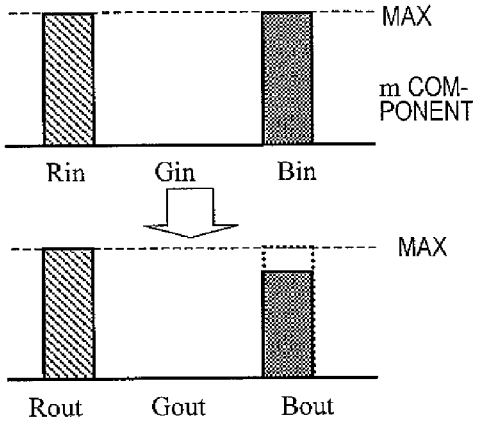

As illustrated in FIG. 7D, when Rin=Bin=Max (for example, 255) and Gin=0, in other words, when a pixel is to display magenta, Rin and Bin have the same value and this value of Rin or Bin is regarded as the m component. In this case, Bin>0 is satisfied and the m component is present as an additional component to the b component and the w component. The situation therefore matches Case 1 and the color tone correction circuit 120 corrects Bout.

Figure 7E:
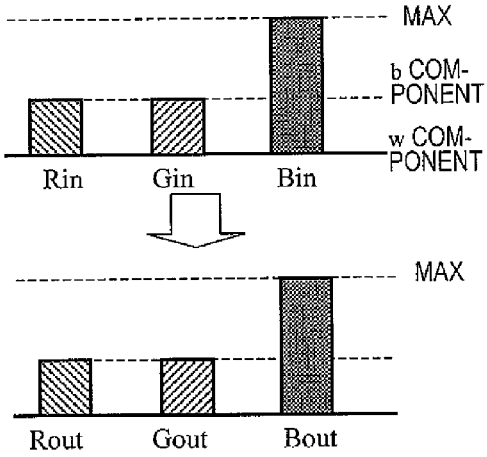

As illustrated in FIG. 7E, when Bin>Rin=Gin>0, the smallest of the values of Rin, Gin, and Bin (namely, value of Rin or Gin) is regarded as the w component, and the value of Bin−Gin or Bin−Rin is regarded as the b component. In this case, Bin>0 is satisfied but no other components than the b component and the w component are present. Therefore, Case 2 applies and the color tone correction circuit 120 does not correct Bout, which gives Bout the same value as Bin. The luminance of the blue sub-pixel does not need to be corrected when the color components present are only the b component and/or the w component because the color tone is hardly shifted in such cases as may be understood from FIG. 6.

Figure 7F:
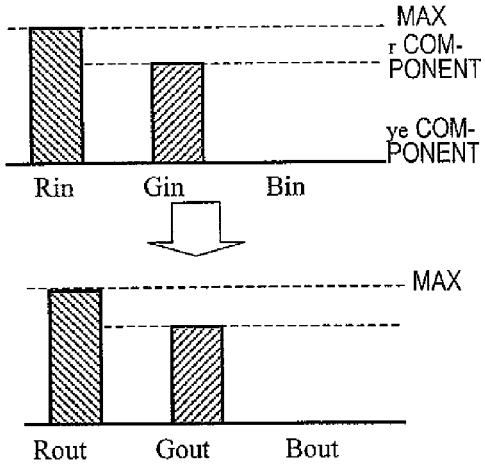

As illustrated in FIG. 7F, when Rin>Gin>Bin=0, the smaller one of the values of Rin and Gin (namely, value of Gin) is regarded as the ye component and the value of Rin−Gin is regarded as the r component. In this case, Bin=0 and the r component and the ye component are present as other components than the b component and the w component. Therefore, Case 3 applies and the color tone correction circuit 120 does not correct Bout. Bout is not corrected because Bin is zero and may not be corrected.

Figure 8A:
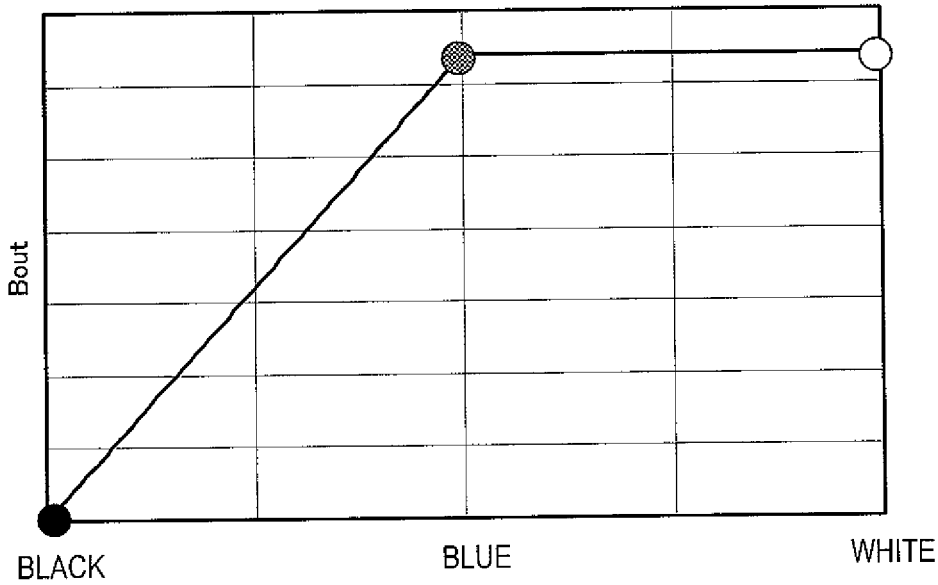
FIG. 8A is a graph illustrating a change in luminance of a blue sub-pixel that is observed when the pixel color changes from black to blue and then to white in the liquid crystal display device of Comparative Example 1.
Figure 8B:
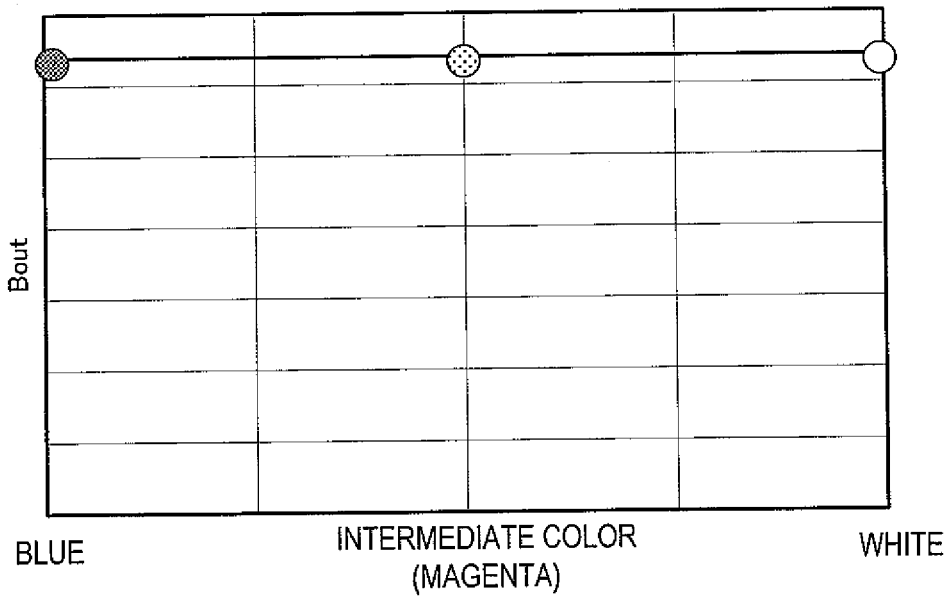
FIG. 8B is a graph illustrating a change in luminance of the blue sub-pixel that is observed when the pixel color changes from blue to an intermediate color (magenta, for example) and then to white.

The description returns to the comparison of the liquid crystal display device of this embodiment against the liquid crystal display device of Comparative Example 1. Described first with reference to FIGS. 8A and 8B is a change in blue sub-pixel luminance (Bout) that accompanies a change in pixel color in the liquid crystal display device of Comparative Example 1. The blue sub-pixel luminance (Bout) is the luminance of the blue sub-pixel that is indicated by a signal input to a liquid crystal display panel in the liquid crystal display device of Comparative Example 1. FIG. 8A illustrates a change in blue sub-pixel luminance (Bout) that is observed when the pixel color changes from black to blue and then to white. FIG. 8B illustrates a change in blue sub-pixel luminance (Bout) that is observed when the pixel color changes from blue to an intermediate color (for example, magenta) and then to white. Those changes are the same as those in the conventional liquid crystal display device.

As illustrated in FIG. 8A, when the pixel color is black, the blue sub-pixel luminance is the minimum luminance. The luminances of the red and green sub-pixels at this point are also the minimum luminance. As the pixel color changes from black to blue, the blue sub-pixel luminance increases. When the pixel color completes the change to blue, the luminance of the blue sub-pixel reaches the maximum luminance. Here, the maximum luminance is 255 as in the case of the gray scale level. As the pixel color subsequently changes from blue to white, the blue sub-pixel luminance is kept at the maximum luminance whereas the luminances of the red and green sub-pixels increase. When the pixel color completes the change to white, the luminances of the red and green sub-pixels reach the maximum luminance.

As illustrated in FIG. 8B, when the pixel color is blue, the blue sub-pixel luminance is the maximum luminance. The luminances of the red and green sub-pixels at this point are the minimum luminance. As the pixel color changes from blue to magenta, the blue sub-pixel luminance is kept at the maximum luminance whereas the luminance of the red sub-pixel increases. When the pixel color completes the change to magenta, the luminance of the red sub-pixel reaches the maximum luminance. As the pixel color subsequently changes from magenta to white, the luminances of the red and blue sub-pixel are kept at the maximum luminance whereas the luminance of the green sub-pixel increases. When the pixel color completes the change to white, the luminance of the green sub-pixel reaches the maximum luminance.

Described next with reference to FIGS. 9A to 9D is a change in blue sub-pixel luminance that accompanies a change in pixel color in the liquid crystal display device of this preferred embodiment. FIG. 9A illustrates a change in blue sub-pixel luminance (Bout) indicated by a corrected image signal that is observed when the pixel color changes from black to blue and then to white. FIG. 9B illustrates, in a manner parallel to the change in FIG. 9A, changes in Rin, Gin, Bin, b component, w component, and m component that are indicated by an image signal. FIG. 9C illustrates a change in blue sub-pixel luminance (Bout) indicated by a corrected image signal that is observed when the pixel color changes from blue to an intermediate color (magenta, for example) and then to white. FIG. 9D illustrates, in a manner parallel to the change in FIG. 9C, changes in Rin, Gin, Bin, b component, w component, and m component that are indicated by an image signal.

As illustrated in FIGS. 9A and 9B, when the pixel color is black, in other words, when Rin, Gin, and Bin are zero, the b component, the w component, and the m component are all zero and Bout is zero (minimum luminance). At this point, the red sub-pixel luminance (Rout) and the blue sub-pixel luminance (Bout), which are indicated by a corrected image signal, are zero as well. As Bin increases while Rin and Gin are kept at zero to change the pixel color from black to blue, the b component increases, thereby increasing Bout. When the pixel color completes the change to blue, in other words, when Bin reaches 255, the b component reaches 255 as well. Bout at this point is 255. As Rin and Gin subsequently increase while Bin is kept at 255, which causes the pixel color to change from blue to white, the b component decreases and the w component increases. Bout at this point remains 255 whereas Rout and Gout increase. When the pixel color completes the change to white, in other words, when Rin, Gin, and Bin reach 255, the b component is zero and the w component is 255. Rout and Gout at this point are 255.

Thus, when the pixel color changes from black to blue and then to white, Bin>0 is satisfied all the time except a period in which the pixel color is black, but the pixel color contains only the b component and/or the w component, and no other components, including the m component, are present as may be seen in FIG. 9B. This case therefore matches Case 2 described above with reference to Table 2, and the color tone correction circuit 120 does not correct Bout. The change illustrated in FIG. 9A is the same as that in the conventional liquid crystal display device, which is apparent if FIG. 9A is compared with FIG. 8A.

As illustrated in FIGS. 9C and 9D, when the pixel color is blue, in other words, when Rin and Gin are zero and Bin is 255, the b component is 255 whereas the w component and the m component are zero. Bout at this point is 255. As Rin increases while Bin is kept at 255 to change the pixel color from blue to magenta, the b component decreases and the m component increases. This period, in which Bin>0 is satisfied and the m component is present as an additional component to the w component and the b component, matches Case 1 described above with reference to Table 2, and the color tone correction circuit 120 sets Bout lower than Bin. Accordingly, in the liquid crystal display device 100 of this embodiment, Bout decreases despite no changes in Bin as illustrated in FIG. 9C. When Rin and Bin reach 255, which causes the pixel color to complete the change to magenta, the b component becomes zero and the m component reaches 255. At this point, with Bin at 255, Bout is, for example, 179 (=255×0.7), and Rout is 255.

As Gin subsequently increases while Rin and Bin are kept at 255 to change the pixel color from magenta to white, the m component decreases and the w component increases. At this point, Gout increases while Rout remains 255. Bout in this period increases as well. When Rin, Gin, and Bin reach 255, which causes the pixel color to complete the change to white, the m component becomes zero and the w component reaches 255. Gout and Bout at this point reach 255.

Bout registered when the pixel color is magenta is lower than Bout registered when the pixel color is blue and white, as may be seen in FIG. 9C. From a comparison between FIG. 8B and FIG. 9C, it is understood that the liquid crystal display device 100 of this preferred embodiment differs from the liquid crystal display device of Comparative Example 1 in that Bout is low when the pixel color is magenta, which is an intermediate color between blue and red. The liquid crystal display device 100 may thus suppress the above-mentioned shift in color tone in the blue direction by setting the blue sub-pixel luminance lower than its original luminance when the pixel color is an intermediate color. The blue sub-pixel luminance (Bout) in the liquid crystal display device of Comparative Example 1 which is illustrated in FIGS. 8A and 8B corresponds to the original luminance of the blue sub-pixel (Bin) in the liquid crystal display device 100.

Figure 10A:
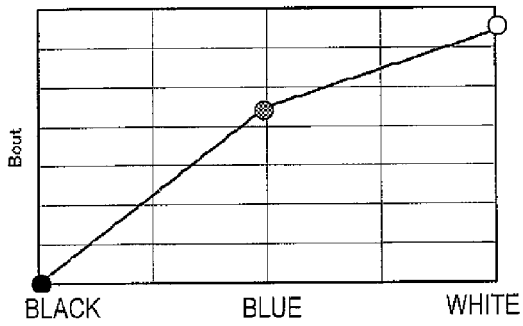
FIG. 10A is a graph illustrating a change in luminance of the blue sub-pixel that is observed when the pixel color changes from black to blue and then to white in the liquid crystal display device of the first preferred embodiment of the present invention.

While Bout registered when the pixel color is blue preferably is equal to Bout registered when the pixel color is white in the description above, the present invention is not limited thereto. As illustrated in FIG. 10A, Bout registered when the pixel color is blue may be lower than Bout registered when the pixel color is white. In this case, as may be seen in FIG. 10B, Bout is an intermediate luminance (179, for example) and Rout and Gout are the minimum luminance when the pixel color is blue, in other words, when Bin is 255. As the pixel color changes from blue to magenta, Rout increases while Bout is kept at the intermediate luminance. When Rin and Bin reach 255 causing the pixel color to complete the change to magenta, Bout is kept at the intermediate luminance whereas Rout reaches 255. As Gin subsequently increases while Rin and Bin are kept at 255 to change the pixel color from magenta to white, Gout increases and Rout remains 255. Bout at this point increases as well. When Rin, Gin, and Bin reach 255, causing the pixel color to complete the change to white, Gout and Bout reach 255.

Figure 10B:
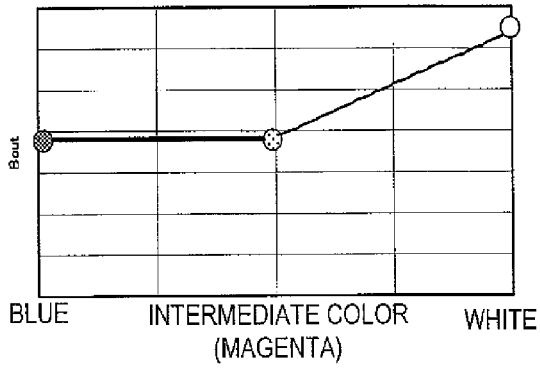
FIGS. 10B to 10D are graphs each illustrating a change in luminance of the blue sub-pixel indicated by a corrected image signal that is observed when the pixel color changes from blue to an intermediate color (magenta, for example) and then to white.
Figure 10C:
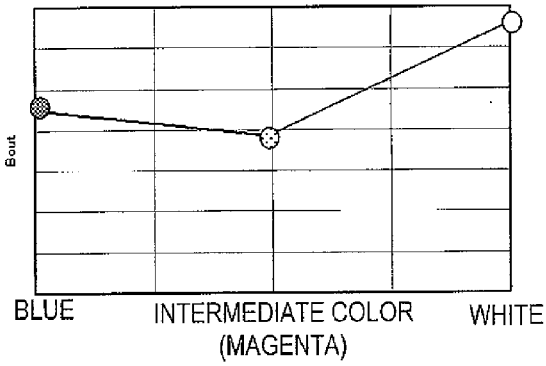
Figure 10D:
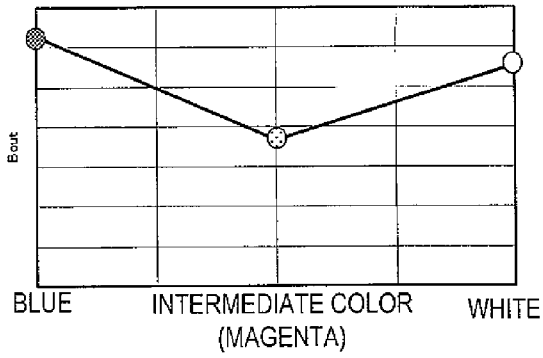

While Bout of FIG. 10B preferably is kept at an intermediate luminance as the pixel color changes from blue to magenta, the present invention is not limited thereto. As illustrated in FIG. 10C, Bout in a period in which the pixel color changes from blue to magenta may be a decreasing intermediate luminance. Alternatively, in the case where the color temperature is high enough (for example, higher than 6,500 K) when white is displayed by setting the luminances of all the sub-pixels to the maximum luminance, the blue sub-pixel luminance for displaying white may be set lower than the maximum luminance. In the case where the blue sub-pixel luminance is lower than the maximum luminance when the pixel color is white, Bout registered when the pixel color is blue may be higher than Bout registered when the pixel color is white as illustrated in FIG. 10D. In those cases, when a pixel displays an arbitrary color containing other color components than the white component and the blue component, the maximum luminance of the blue sub-pixel is lower than a blue sub-pixel luminance at which the pixel displays at least one of white and blue.

Note that the timing of a change in blue sub-pixel luminance (Bout) that accompanies a change in pixel color is not the sole point of the description given with reference to FIGS. 9A to 9D and FIGS. 10A to 10D. The description given with reference to FIGS. 9A to 9D and FIGS. 10A to 10D is nothing but the algorithm for setting a blue sub-pixel luminance (gray scale level) that is suited to the pixel color. This means that, in the liquid crystal display device of this embodiment, the sub-pixel luminance combinations for displaying the colors illustrated in FIGS. 9A to 9D and FIGS. 10A to 10D are set based on the above-mentioned algorithm. In other words, FIGS. 9A to 9D and FIGS. 10A to 10D do not simply point out the timing at which the blue sub-pixel luminance changes, but indicate the blue sub-pixel luminances themselves that are set to display the colors illustrated in FIGS. 9A to 9D and FIGS. 10A to 10D. Bout may be set in advance based on the above-mentioned algorithm, or may be created by calculation. While FIGS. 9A to 9D and FIGS. 10A to 10D illustrate the blue sub-pixel luminance for displaying magenta as an intermediate color, the same applies to cases where cyan is displayed as an intermediate color.

Figure 11:
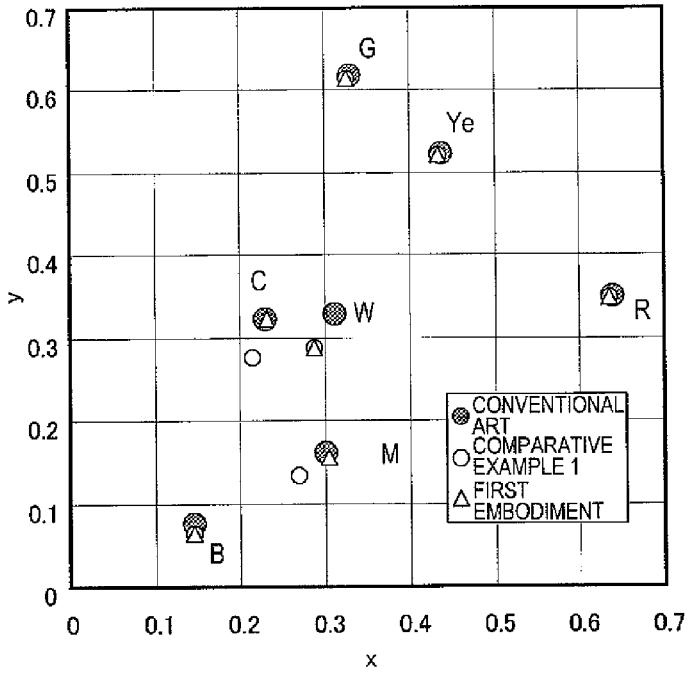
FIG. 11 is a graph illustrating chromaticities at which a pixel displays red (R), green (G), blue (B), yellow (Ye), cyan (C), magenta (M), and white (W) in liquid crystal display devices of the conventional art, Comparative Example 1, and the first preferred embodiment of the present invention.

FIG. 11 illustrates chromaticities at which a pixel displays red (R), green (G), blue (B), yellow (Ye), cyan (C), magenta (M), and white (W) in the liquid crystal display devices of the conventional art, Comparative Example 1, and this preferred embodiment. Here, when a pixel displays cyan and magenta, the blue sub-pixel luminance is set to 0.7 times the original luminance.

As illustrated in FIG. 11, the chromaticity of white in the liquid crystal display device of Comparative Example 1 is shifted in the blue direction from the chromaticity of white in the conventional liquid crystal display device, and the color temperature is higher in the liquid crystal display device of Comparative Example 1 than in the conventional liquid crystal display device. This is because the liquid crystal display device of Comparative Example 1 uses a high color temperature backlight. However, the chromaticities of cyan and magenta in the liquid crystal display device of Comparative Example 1 are shifted in the blue direction from the ones in the conventional liquid crystal display device, thereby causing a shift from the color tone of the conventional liquid crystal display device.

In contrast, the liquid crystal display device of this preferred embodiment which sets the blue sub-pixel luminance to 0.7 times the original luminance when a pixel displays cyan and magenta may have approximately the same cyan and magenta chromaticities as those in the conventional liquid crystal display device, despite the use of a high color temperature backlight. The color temperature in the liquid crystal display device of this embodiment is 9,300 K, which is higher than the color temperature (6,600 K) in the conventional liquid crystal display device, as illustrated in Table 3.

TABLE 3

| | NTSC ratio | Color temperature |
|---|---|---|
| Conventional art | 69% | 6,600 K |
| First embodiment | 69% | 9,300 K |

Figure 12:
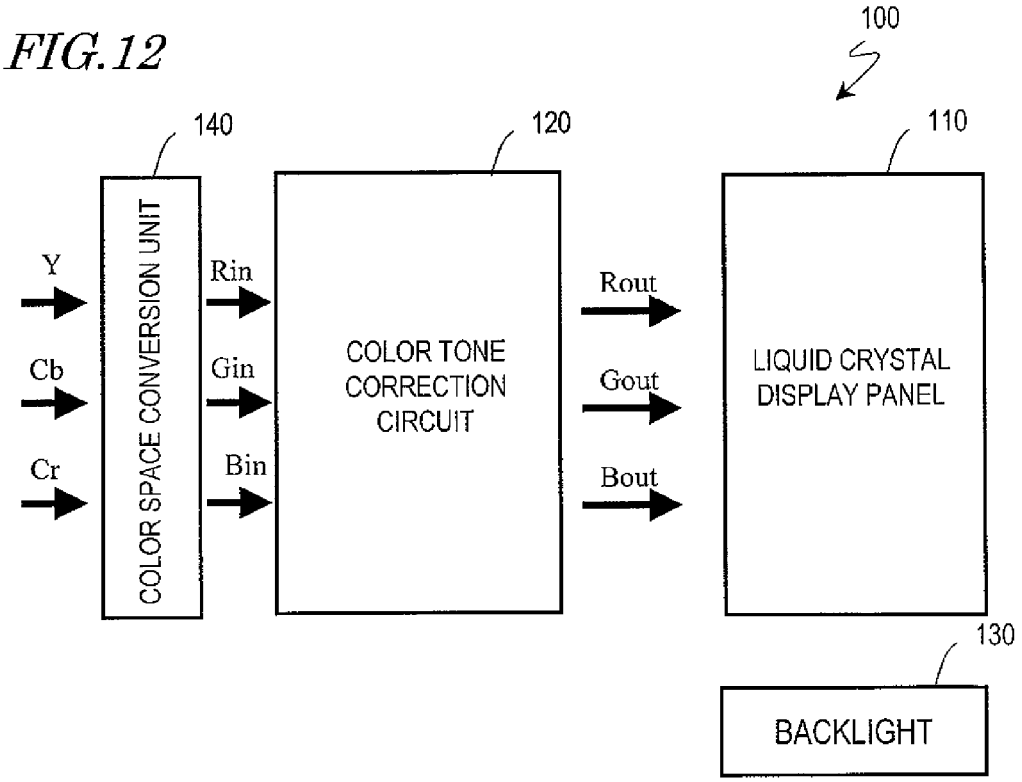
FIG. 12 is a schematic diagram illustrating that the liquid crystal display device of the first preferred embodiment includes a color space conversion unit.

The following description is given on the assumption that signals input to the liquid crystal display device 100 are YCrCb signals, which are commonly used as color television signals. The liquid crystal display device 100 in this case includes, as illustrated in FIG. 12, a color space conversion unit 140, which converts YCrCb signals into RGB signals, and the color tone correction circuit 120 processes the RGB signals obtained through the conversion by the color space conversion unit 140. The color tone correction circuit 120 is mounted to, for example, a substrate of the liquid crystal display panel 110. In the liquid crystal display device 100, the color tone correction circuit 120 creates a corrected image signal which indicates luminances to be actually presented by the red, green, and blue sub-pixels from an image signal which indicates the original luminances of the red, green, and blue sub-pixels.

The liquid crystal display panel 110 is generally provided with a circuit that performs inverse γ correction (not shown). Inverse γ correction is a correction performed when television signals are used to display an image or the like on a display that is not a CRT or other television tubes in order to make the display's linear luminance characteristics, which differ from CRT characteristics, closer to the CRT characteristics. When the liquid crystal display panel 110 is provided with a circuit that performs inverse γ correction, signals that have received γ correction are input to the liquid crystal display panel 110.

Figure 13:
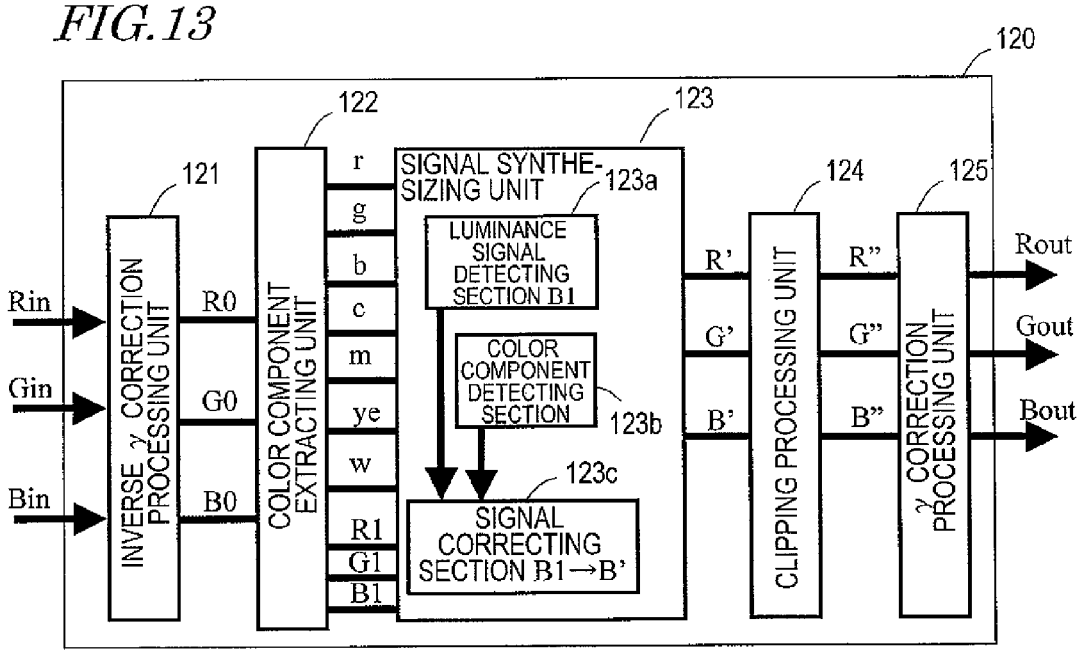
FIG. 13 is a schematic diagram illustrating the structure of a color tone correction circuit in the liquid crystal display device of the first preferred embodiment of the present invention.

A specific structure of the color tone correction circuit 120 is described next with reference to FIG. 13. As illustrated in FIG. 13, the color tone correction circuit 120 has an inverse γ correction processing unit 121, a color component extracting unit 122, a signal synthesizing unit 123, a clipping processing unit 124, and a γ correction processing unit 125. The operation of the structural components of the color tone correction circuit 120 is described below. The assumption here is that image signals to be input to the color tone correction circuit 120 after conversion of YCrCb signals have been corrected by γ correction.

The inverse γ correction unit 121 receives Rin, Gin, and Bin indicating the luminances of the red, green, and blue sub-pixels that have been corrected by γ correction, and performs inverse γ correction to obtain luminances R0, G0, and B0 of the red, green, and blue sub-pixels which are pre-γ correction luminances. Whereas the relation between the gray scale level and the luminance is non-linear in the image signal that has been corrected by γ correction, inverse γ correction performed by the inverse γ correction processing unit 121 makes the relation between the gray scale level and the luminance linear. Subsequently, based on the luminances R0, G0, and B0, the color component extracting unit 122 extracts the r, g, b, c, m, ye, and w components from a pixel color indicated by the image signal, and outputs the extracted components to the signal synthesizing unit 123, along with the luminances R0, G0, and B0, which are output as luminances R1, G1, and B1.

The signal synthesizing unit 123 includes a luminance signal detecting section 123*a*, a color component detecting section 123*b*, and a signal correcting section 123*c*. The luminance signal detecting section 123*a* determines whether or not the luminance B1 of the blue sub-pixel is larger than zero. The color component detecting section 123*b* determines whether or not any of other components than the b and w components, namely, any of the r, g, c, m, and ye components takes a value other than zero. When the luminance signal detecting section 123*a* detects that the luminance B1 of the blue sub-pixel is larger than zero and the color component detecting section 123*b* detects that any of the r, g, c, m, and ye components takes a value other than zero, the signal correcting section 123*c* calculates the product of the luminance B1 of the blue sub-pixel and a predetermined value (0.7 to 1) and outputs the result of the calculation as B'. In other cases, the signal correcting section 123*c* outputs the luminance B1 of the blue sub-pixel as B'. The predetermined value is set according to the amount of other color components than the blue component and the white component. For example, the predetermined value is small when the amount of other components than the blue component and the white component is large whereas, when other components than the blue component and the white component are present in a small amount, the predetermined value is large (approaches 1). The signal synthesizing unit 123 outputs R1 and G1 as R' and G', respectively.

The clipping processing unit 124 performs clipping processing on the luminances R', G', and B' output from the signal synthesizing unit 123. Clipping processing is processing for keeping a luminance within its intended range by preventing the luminance from exceeding the maximum value of the intended range or coming short of the minimum value thereof through conversion to the maximum value or the minimum value. The γ correction processing unit 125 next performs γ correction on R", G", and B", which are obtained through the clipping processing of R', G', and B', and outputs the corrected luminances as Rout, Gout, and Bout to the liquid crystal display panel 110. In the manner as described above, the color tone correction circuit 120 may create a corrected image signal which indicates luminances to be actually presented by the red, green, and blue sub-pixels from an image signal which indicates the original luminances of the red, green, and blue sub-pixels.

The description above has been given based on the assumption that signals input to the liquid crystal display device 100 are YCrCb signals, which are commonly used as color television signals, but are not limited to YCrCb signals. Instead, the input signals may be ones that indicate the luminances of the sub-pixels of the three primary colors R, G, and B, or may be ones that indicate the luminances of the sub-pixels of other three primary colors such as YeMC (Ye: yellow, M: magenta, C: cyan).

The color tone correction circuit 120 in the description above has the inverse γ correction processing unit 121, which performs inverse γ correction on an image signal that has received γ correction, but the present invention is not limited thereto. If no problem arises in practice, an image signal on which γ correction has been performed may be subjected to the subsequent processing without receiving inverse γ correction and, in this case, the inverse γ correction processing unit 121 may be omitted. Alternatively, the inverse γ correction processing 121 may be omitted in the case where an image signal does not receive γ correction before input to the color tone correction circuit 120.

The color tone correction circuit 120 in the description above preferably varies the blue sub-pixel luminance with respect to its original luminance in a uniform manner according to the amount of other color components than the b component and the w component. However, the present invention is not limited thereto. The blue sub-pixel luminance may be varied according to a function that sets the blue sub-pixel luminance lower than its original luminance.

While the sub-pixels preferably have equal areas in the description above, the present invention is not limited thereto. The sub-pixels may have different areas.

In the description above, the blue sub-pixel luminance is corrected when the pixel color is a color containing any of other color components than the white component and the blue component (namely, r, g, ye, c, and m components). However, the present invention is not limited thereto. The blue sub-pixel luminance may be corrected when a color to be displayed by a pixel contains at least one predetermined color component other than the white component and the blue component. The color tone correction circuit 120 may correct the blue sub-pixel luminance only when the pixel color contains the magenta (m) component or the cyan (c) component because, in the liquid crystal display device of Comparative Example 1, a shift in color tone is particularly large when the pixel color contains the magenta component or the cyan component.

A pixel in the description above preferably has red, green, and blue sub-pixels, but the present invention is not limited thereto. The sub-pixels in a pixel may employ other color combinations as long as the pixel has a blue sub-pixel.

Figure 14:
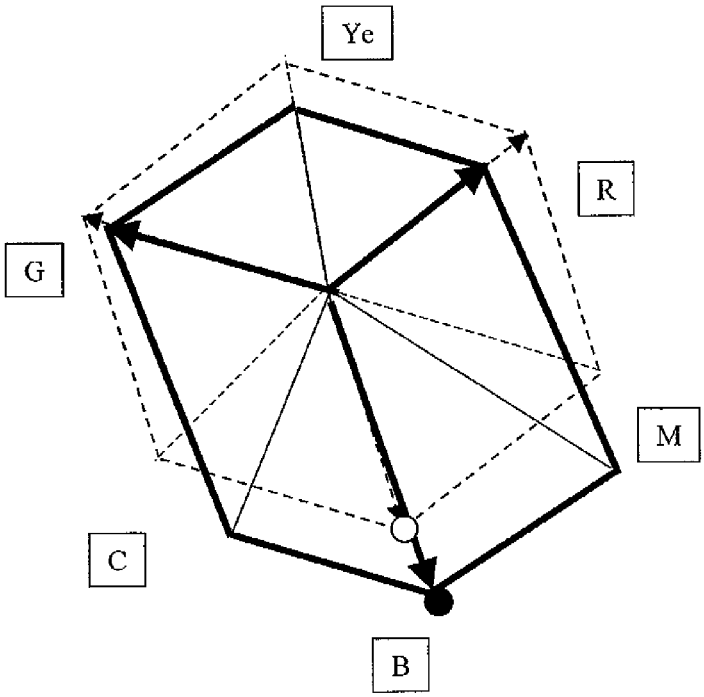
FIG. 14 is a schematic diagram illustrating that a shift in chromaticity is suppressed in the liquid crystal display device of the first preferred embodiment of the present invention.

In the description above, three cases Case 1 to Case 3 are used as illustrated in Table 2 to determine whether to correct Bout. However, the present invention is not limited thereto. As illustrated in Table 4, Bout may be corrected when the contained color component is not the w component, for example, when the pixel color contains the b component alone. This is particularly effective when the deviation of the chromaticity of white in the liquid crystal display device of this preferred embodiment from a straight line that connects the chromaticity of white and the chromaticity of blue in the liquid crystal display device of Comparative Example 1 is relatively large. Further, as illustrated in FIG. 14, the chromaticity registered when the blue sub-pixel is at the highest gray scale in the liquid crystal display device of Comparative Example 1 differs from the chromaticity registered when the blue sub-pixel is at the highest gray scale in the conventional liquid crystal display device, and hence setting the blue sub-pixel luminance lower than its original luminance may suppress a shift in color tone in the liquid crystal display device of this preferred embodiment.

TABLE 4

| | Bin > 0 | Presence of other color components than w component | Need to correct Bout |
|---|---|---|---|
| Case A | Yes | Yes | Yes |
| Case B | Yes | No | No |
| Case C | No | No | No |

In Table 4, Bout preferably is not corrected when the only color component of a pixel color is the w component as illustrated in Case B, but the present invention is not limited thereto. A shift in color tone may be suppressed by correcting Bout as long as Bin>0 is satisfied.

While the color temperature of the liquid crystal display device in the description above preferably is 9,300 K, the present invention is not limited thereto. The color temperature may be adjusted by changing the gamma characteristics (gray scale-luminance characteristics) of respective sub-pixels. For example, the color temperature may be 8,000 K or more and 15,000 K or less.

Second Embodiment

A liquid crystal display device of a second preferred embodiment according to the present invention is described below with reference to FIGS. 15 to 23. The liquid crystal display device of this preferred embodiment differs from the liquid crystal display device of the first preferred embodiment in that each pixel has a yellow sub-pixel in addition to the red, green, and blue sub-pixels. The liquid crystal display device 100 of this preferred embodiment preferably has the same structure as that of the above-mentioned liquid crystal display device of the first preferred embodiment, and descriptions on overlapping points are omitted in order to avoid redundancy. However, as described later, the color tone correction circuit 120 in the liquid crystal display device 100 of this preferred embodiment creates a corrected image signal that indicates the luminances of the red, green, blue, and yellow sub-pixels by correcting the luminance of the blue sub-pixel.

Figure 15:
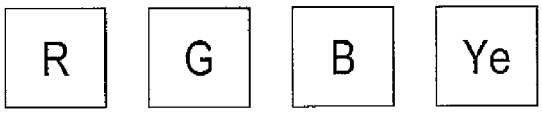
FIG. 15 is a schematic diagram illustrating a single pixel in a liquid crystal display device of a second preferred embodiment according to the present invention.
Figure 16:
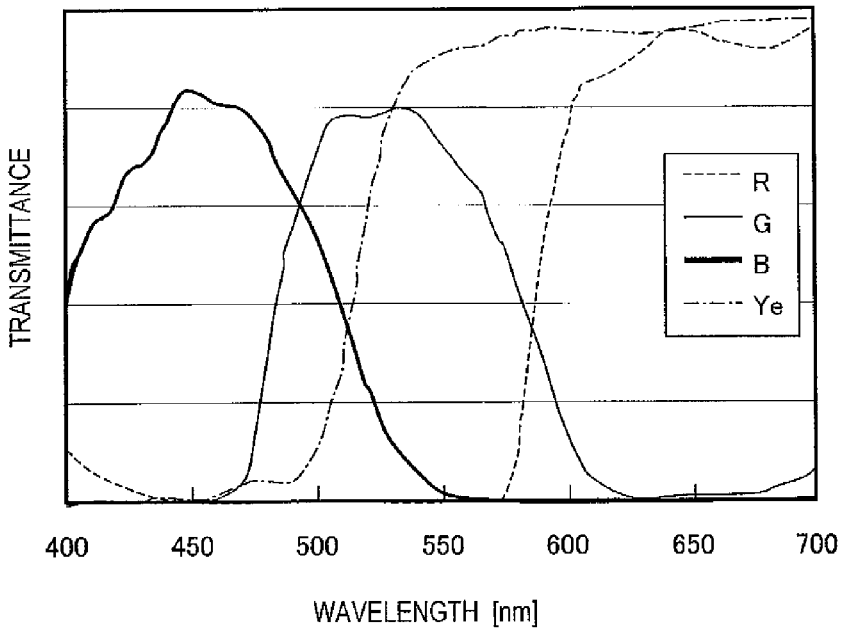
FIG. 16 is a graph illustrating transmittances of color filter elements which correspond to sub-pixels in the liquid crystal display device of the second preferred embodiment of the present invention.

FIG. 15 illustrates four sub-pixels that are contained within a single pixel in the liquid crystal display device 100 of this preferred embodiment, namely, red (R), green (G), blue (B), and yellow (Ye) sub-pixels. FIG. 16 illustrates the transmittances of color filter elements which correspond to the respective sub-pixels in the liquid crystal display device 100 of this preferred embodiment. In FIG. 16, Ye represents a transmittance at which the color filter element of the yellow sub-pixel transmits light of varying wavelengths. R, G, and B represent transmittances at which the color filter elements of the red, green, and blue sub-pixels transmit light of varying wavelengths, and the transmittances of FIG. 16 are the same as the color filter transmittances of varying wavelengths in the liquid crystal display device of the first preferred embodiment which have been described with reference to FIG. 3.

The liquid crystal display device of this preferred embodiment has an expanded reproducible color gamut owing to the inclusion of the yellow sub-pixel in a pixel. However, as described above, adding the yellow sub-pixel gives a color displayed by a pixel a yellowish overtone and lowers the color temperature. The liquid crystal display device of this preferred embodiment therefore achieves a predetermined color temperature by using a high color temperature backlight.

Figure 17:
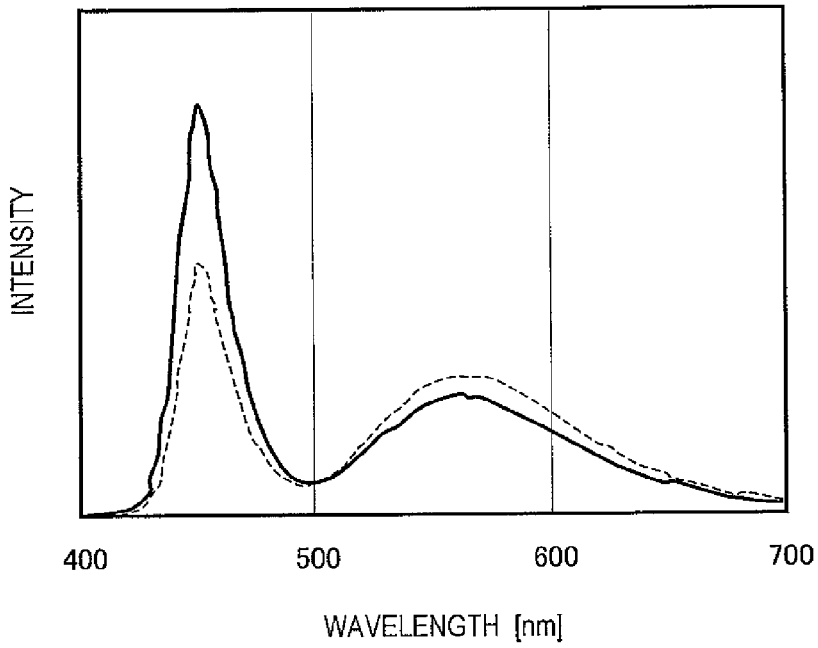
FIG. 17 is a graph illustrating spectra of backlights in a conventional liquid crystal display device and the liquid crystal display device of the second preferred embodiment of the present invention.

In FIG. 17, the spectrum of an LED that is used as a backlight in the liquid crystal display device of this preferred embodiment is illustrated in solid line and, for reference, the spectrum of an LED that is used as a backlight in a conventional liquid crystal display device is illustrated in broken line. Note that the backlight in the conventional liquid crystal display device is the same as the one illustrated in FIG. 4.

Figure 18:
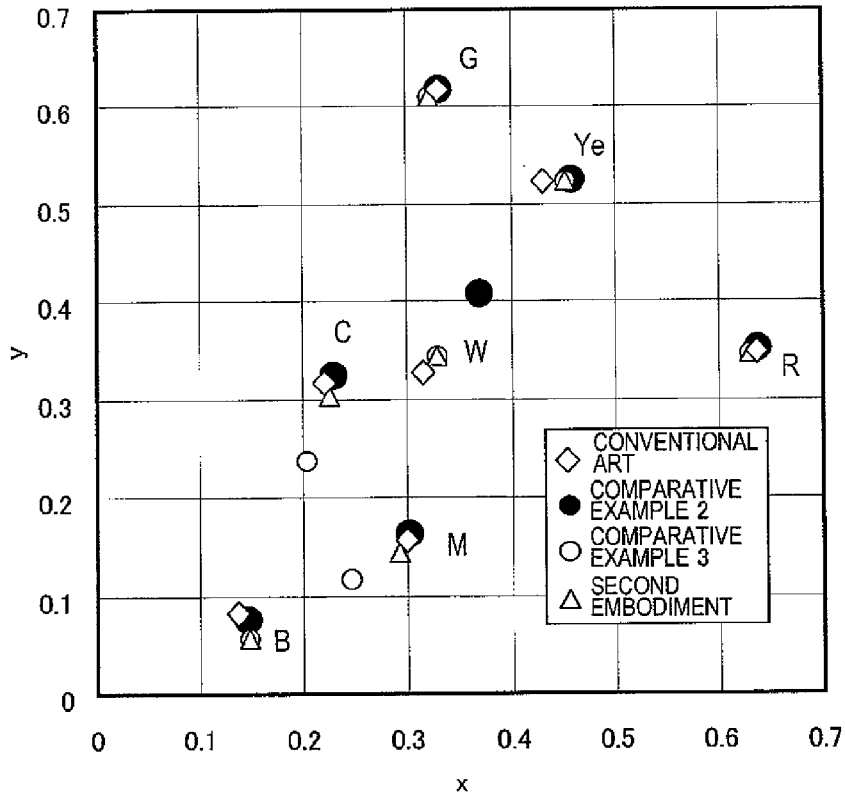
FIG. 18 is a graph illustrating chromaticities at which a pixel displays red (R), green (G), blue (B), yellow (Ye), cyan (C), magenta (M), and white (W) in liquid crystal display devices of the conventional art, Comparative Examples 2 and 3, and the second preferred embodiment of the present invention.

FIG. 18 illustrates chromaticities at which a pixel displays red (R), green (G), blue (B), yellow (Ye), cyan (C), magenta (M), and white (W) in liquid crystal display devices of the conventional art, Comparative Examples 2 and 3, and this preferred embodiment. The conventional liquid crystal display device here is the same as the RGB three-primary color liquid crystal display device that has been described with reference to FIG. 11. The liquid crystal display devices of Comparative Examples 2 and 3 are similar to the liquid crystal display device of this preferred embodiment in that a signal that indicates the luminances of four sub-pixels is created from an image signal that indicates the original luminances of the respective sub-pixels in a single pixel includes only the red, green, and blue sub-pixels in Comparative Examples 2 and 3. The liquid crystal display device of Comparative Example 2 differs from the liquid crystal display device of this preferred embodiment in that the blue sub-pixel luminance is not corrected and that the conventional backlight is employed. The liquid crystal display device of Comparative Example 3 differs from the liquid crystal display device 100 of this preferred embodiment in that the blue sub-pixel luminance is not corrected. The liquid crystal display device 100 of this preferred embodiment sets the blue sub-pixel luminance to 0.6 times the original luminance when the pixel displays cyan and magenta.

Table 5 illustrates Y values and chromaticities x, y at which a pixel displays cyan (C) and magenta (M) in the liquid crystal display devices of the conventional art, Comparative Examples 2 and 3, and this embodiment.

TABLE 5

| | C | | | M | | |
|---|---|---|---|---|---|---|
| | Y | x | y | Y | x | y |
| Conventional art | 6.62 | 0.2291 | 0.3234 | 2.63 | 0.3000 | 0.1616 |
| Comparative Example 2 | 4.99 | 0.2298 | 0.3241 | 2.00 | 0.3006 | 0.1632 |
| Comparative Example 3 | 5.10 | 0.2040 | 0.2368 | 2.11 | 0.2455 | 0.1157 |
| Second embodiment | 4.77 | 0.2250 | 0.3034 | 1.78 | 0.2915 | 0.1434 |

The display size and resolution of the liquid crystal display device of this preferred embodiment preferably are equal to those of the conventional liquid crystal display device, and the area of a single sub-pixel in the liquid crystal display device of this preferred embodiment is smaller than (¾ of) the area of a single sub-pixel in the conventional liquid crystal display device. Accordingly, the Y value in the liquid crystal display device of this preferred embodiment is smaller than that in the conventional liquid crystal display device, as illustrated in Table 5.

As illustrated in FIG. 18, the chromaticity of white in the liquid crystal display device of Comparative Example 2 is shifted in the yellow direction from the chromaticity of white in the conventional liquid crystal display device. This is because the liquid crystal display device of Comparative Example 2 uses a color filter that has an additional yellow sub-pixel.

The chromaticity of white in the liquid crystal display device of Comparative Example 3 is approximately the same as the chromaticity of white in the conventional liquid crystal display device, and is shifted in the blue direction from the chromaticity of white in the liquid crystal display device of Comparative Example 2. Accordingly, the color temperature in the liquid crystal display device of Comparative Example 3 is higher than that in the liquid crystal display device of Comparative Example 2. This is because the liquid crystal display device of Comparative Example 3 uses a high color temperature backlight. However, the chromaticities of cyan and magenta in the liquid crystal display device of Comparative Example 3 are shifted in the blue direction from the cyan and magenta chromaticities in the liquid crystal display device of Comparative Example 2, and the color tone in the liquid crystal display device of Comparative Example 3 is shifted from the ones in the liquid crystal display devices of the conventional art and Comparative Example 2.

In contrast, the liquid crystal display device of this embodiment which sets the blue sub-pixel luminance to 0.6 times the original luminance when a pixel displays cyan and magenta may have approximately the same cyan and magenta chromaticities as those in the liquid crystal display devices of the conventional art and Comparative Example 2, despite the use of a high color temperature backlight. The liquid crystal display device of this preferred embodiment may thus suppress a shift in color tone.

As illustrated in Table 6, the color temperature in the liquid crystal display device of this preferred embodiment is 5,700 K, which is higher than the color temperature (4,400 K) in the liquid crystal display device of Comparative Example 2. Further, in the liquid crystal display device of this preferred embodiment in which each pixel has a yellow sub-pixel, the NTSC ratio is slightly higher than the one in the first preferred embodiment which is illustrated in Table 3.

TABLE 6

| | NTSC ratio | Color temperature |
|---|---|---|
| Comparative Example 2 | 70% | 4,400 K |
| Second embodiment | 71% | 5,700 K |

The liquid crystal display device of this preferred embodiment, too, determines whether to correct Bout based on which one of Case 1 to Case 3 applies, as has been described in the first preferred embodiment with reference to Table 2. Bout correction by the color tone correction circuit 120 is described below with reference to FIGS. 19A to 19D through concrete examples. Here, the luminances of the red, green, and blue sub-pixels that are indicated by an image signal are denoted by Rin, Gin, and Bin, respectively, whereas the luminances of the red, green, blue, and yellow sub-pixels that are indicated by a signal created in the liquid crystal display devices of this embodiment and Comparative Example 3 are denoted by Rout, Gout, Bout, and Yeout, respectively. As described above, a signal that indicates the luminances of the four sub-pixels is created in the liquid crystal display device of Comparative Example 3, but the liquid crystal display device of Comparative Example 3 differs from the liquid crystal display device of this preferred embodiment in that the blue sub-pixel luminance is not corrected. Illustrated in FIGS. 19A to 19D are results obtained when Yeout is a predetermined value.

Figure 19A:
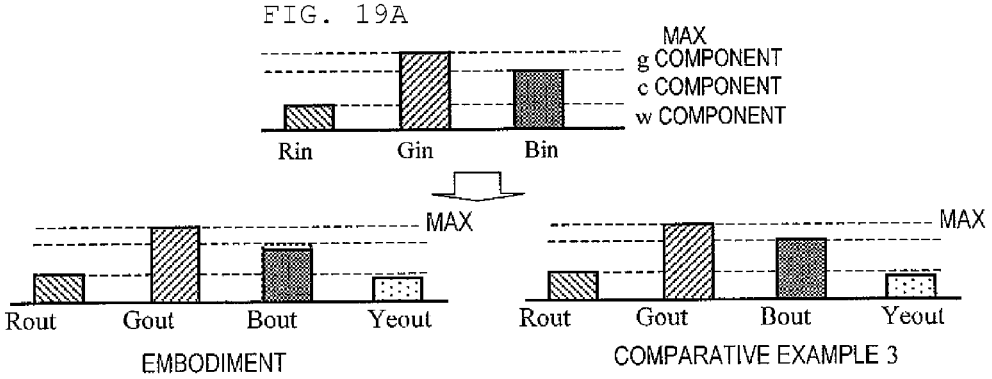
FIGS. 19A to 19D are schematic diagrams each illustrating a relationship between luminances of sub-pixels that are indicated by an image signal and luminances of the sub-pixels that are indicated by a corrected image signal in the liquid crystal display device of the second preferred embodiment of the present invention.

As illustrated in FIG. 19A, when Gin>Bin>Rin>0 in the liquid crystal display device of this preferred embodiment, the smallest of the values of Rin, Gin, and Bin (namely, value of Rin) is regarded as the w component and, of Gin−Rin, which is a subtraction of this smallest value from Gin, and Bin−Rin, which is a subtraction of this smallest value from Bin, the smaller one (namely, value of Bin−Rin) is regarded as the c component. The value of Gin−Bin is regarded as the g component. In this case, Bin>0 is satisfied and the g component and the c component are present as other components than the b component and the w component. The situation therefore matches Case 1 and the color tone correction circuit 120 makes a correction so that Bout is lower than Bin.

Figure 19B:
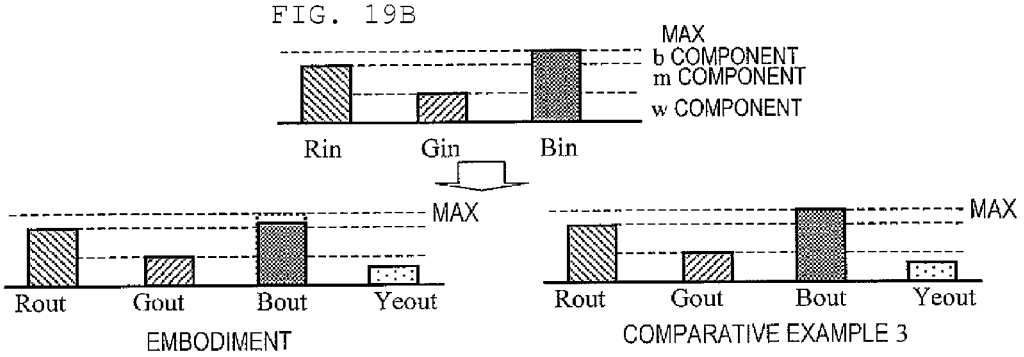

As illustrated in FIG. 19B, when Bin>Rin>Gin>0 in the liquid crystal display device of this preferred embodiment, the smallest of the values of Rin, Gin, and Bin (namely, value of Gin) is regarded as the w component and, of Rin−Gin, which is a subtraction of this smallest value from Rin, and Bin−Gin, which is a subtraction of this smallest value from Bin, the smaller one (namely, value of Rin−Gin) is regarded as the m component. The value of Bin−Rin is regarded as the b component. In this case, Bin>0 is satisfied and the m component is present as an additional component to the b component and the w component. The situation therefore matches Case 1 and the color tone correction circuit 120 makes a correction so that Bout is lower than Bin.

Figure 19C:
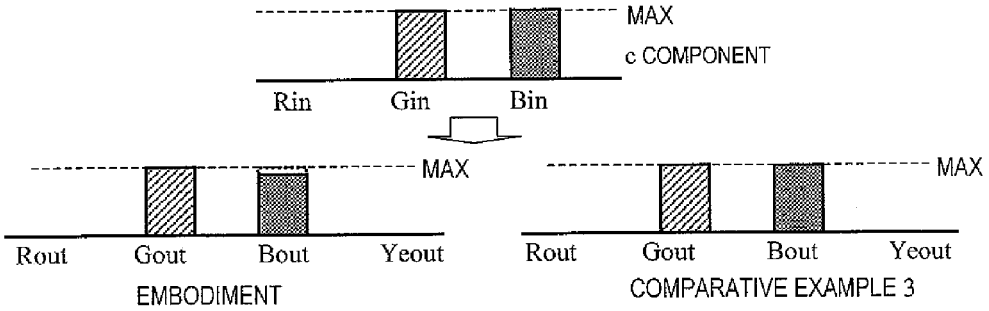

As illustrated in FIG. 19C, when Gin=Bin=Max (for example, 255) and Rin=0, in other words, when a pixel is to display cyan, Gin and Bin have the same value and this value of Gin or Bin is regarded as the c component in the liquid crystal display device of this preferred embodiment. In this case, Bin>0 is satisfied and the c component is present as an additional component to the b component and the w component. The situation therefore matches Case 1 and the color tone correction circuit 120 makes a correction so that Bout is lower than Bin.

Figure 19D:
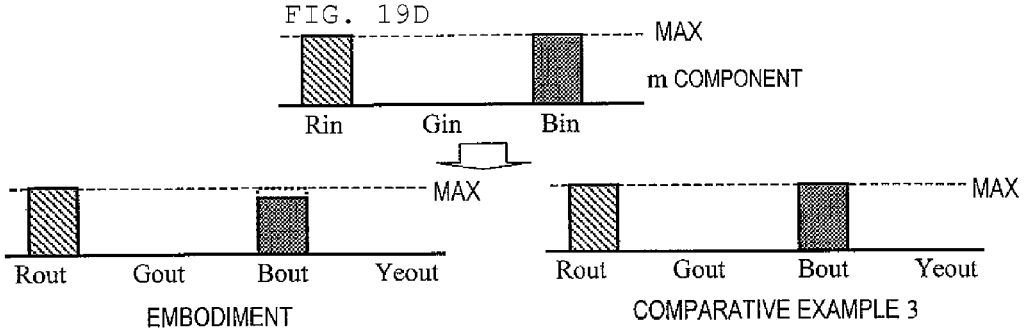

As illustrated in FIG. 19D, when Rin=Bin=Max (for example, 255) and Gin=0, in other words, when a pixel is to display magenta, Rin and Bin have the same value and this value of Rin or Bin is regarded as the m component in the liquid crystal display device of this preferred embodiment. In this case, Bin>0 is satisfied and the m component is present as an additional component to the b component and the w component. The situation therefore matches Case 1 and the color tone correction circuit 120 makes a correction so that Bout is lower than Bin.

Figure 20:
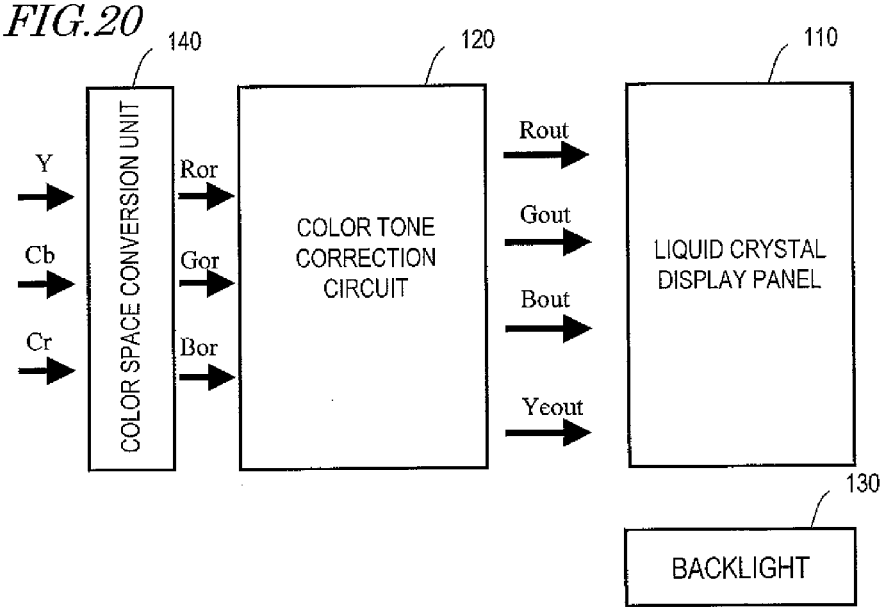
FIG. 20 is a schematic diagram illustrating that the liquid crystal display device of the second preferred embodiment includes a color space conversion unit.

The following description is given based on the assumption that signals input to the liquid crystal display device 100 are YCrCb signals, which are commonly used as color television signals. The liquid crystal display device 100 in this case includes, as illustrated in FIG. 20, the color space conversion unit 140, which converts YCrCb signals into RGB signals, and the color tone correction circuit 120 processes the RGB signals obtained through the conversion by the color space conversion unit 140. In the liquid crystal display device 100 of this preferred embodiment, the color tone correction circuit 120 creates a corrected image signal which indicates the luminances of the red, green, blue, and yellow sub-pixels (Rout, Gout, Bout, and Yeout) from an image signal which indicates the luminances of the respective sub-pixels in a pixel that includes only red, green, and blue sub-pixels (Rin, Gin, and Bin).

Figure 21:
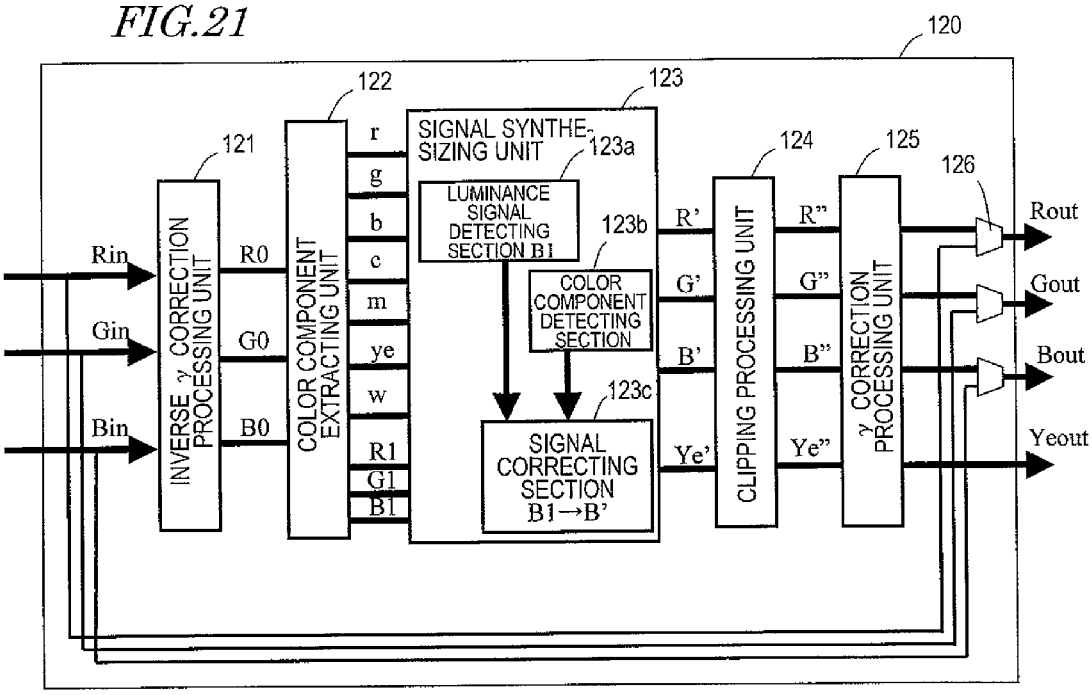
FIG. 21 is a schematic diagram illustrating the structure of a color tone correction circuit in the liquid crystal display device of the second preferred embodiment of the present invention.

A specific structure of the color tone correction circuit 120 is described next with reference to FIG. 21. As illustrated in FIG. 21, the color tone correction circuit 120 includes the inverse γ correction processing unit 121, the color component extracting unit 122, the signal synthesizing unit 123, the clipping processing unit 124, the γ correction processing unit 125, and selectors 126. The operation of the structural components of the color tone correction circuit 120 is described below.

The inverse γ correction processing unit 121 receives an image signal which indicates the original luminances of the red, green, and blue sub-pixels, Rin, Gin, and Bin. Here, Rin, Gin, and Bin represent the luminances of the red, green, and blue sub-pixels that have been corrected by γ correction, and pre-γ correction luminances R0, G0, and B0 of the red, green, and blue sub-pixels are obtained by performing inverse γ correction on Rin, Gin, and Bin. Based on the luminances R0, G0, and B0, the color component extracting unit 122 extracts the r, g, b, c, m, ye, and w components from a pixel color indicated by the image signal, and outputs the extracted components to the signal synthesizing unit 123, along with the luminances R0, G0, and B0, which are output as luminances R1, G1, and B1. Note that Rin, Gin, and Bin represent the luminance of the sub-pixels when a three-primary color liquid crystal display panel is employed, and R0, G0, B0, R1, G1, and B1 which are obtained by processing Rin, Gin, and Bin are the same as when a three-primary color liquid crystal display panel is employed.

The signal synthesizing unit 123 converts the luminances R1, G1, and B1 into the luminances of four primary colors. This conversion is performed, for example, in accordance with a method disclosed in JP 2005-303989 A. The disclosed contents of JP 2005-303989 A are cited herein by reference. Through the above-mentioned conversion, the signal synthesizing unit 123 creates a corrected image signal that indicates the luminances of the red, green, blue, and yellow sub-pixels from an image signal that indicates the luminances of the respective sub-pixels in a pixel including only red, green, and blue sub-pixels.

The signal synthesizing unit 123 includes the luminance signal detecting section 123*a*, the color component detecting section 123*b*, and the signal correcting section 123*c*. The luminance signal detecting section 123*a* determines whether or not the luminance B1 of the blue sub-pixel is larger than zero. The color component detecting section 123*b* determines whether or not any of other components than the b and w components, namely, any of the r, g, c, m, and ye components takes a value other than zero. When the luminance signal detecting section 123*a* detects that the luminance B1 of the blue sub-pixel is larger than zero and the color component detecting section 123*b* detects that any of the r, g, c, m, and ye components takes a value other than zero, the signal correcting section 123*c* calculates the product of the luminance B1 of the blue sub-pixel and a predetermined value (0.6 to 1) and outputs the result of the calculation to the clipping processing unit 124 as B'. In other cases, the signal correcting section 123*c* outputs the luminance B1 of the blue sub-pixel thereto as B'. The predetermined value is set according to the amount of other color components than the blue component and the white component.

If necessary, the signal synthesizing unit 123 may set Ye' to a value that is not zero so that, by setting Ye', R1 and G1 are adjusted in a manner that returns a shifted hue to the original hue. The adjusted R1 and G1 are denoted by R' and G'. Note that, in setting Ye' in order to return a shifted hue to the original hue, B' does not need to be adjusted because yellow is the complementary color to blue. The signal synthesizing unit 123 subsequently outputs R', G', and Ye' to the clipping processing unit 124. The signal synthesizing unit 123 performs hue correction processing in the manner as described above.

The clipping processing unit 124 performs clipping processing on the luminances R', G', B', and Ye' output from the signal synthesizing unit 123. The γ correction processing unit 125 next performs γ correction on R", G", B", and Ye", which are obtained through the clipping processing of R', G', B', and Ye', and outputs the corrected luminances as Rout, Gout, Bout, and Yeout to the liquid crystal display panel 110.

The color tone correction circuit 120 in description above preferably corrects the blue sub-pixel luminance to be equal to or larger than 0.6 times the original luminance and smaller than 1.0 times the original luminance. However, the present invention is not limited thereto. The color tone correction circuit 120 may correct the blue sub-pixel luminance to be equal to or larger than 0.4 times the original luminance and smaller than 1.0 times the original luminance.

In the case where a multi-primary color liquid crystal display panel is employed as the liquid crystal display panel 110, the color tone correction circuit 120 corrects the color tone by correcting the blue sub-pixel luminance in the manner as described above. When it is a three-primary color liquid crystal display panel that is employed as the liquid crystal display panel 110, the color tone correction circuit 120 does not need to correct the color tone. In this case, a switch is made among the selectors 126 so that Rin, Gin, and Bin indicated by the image signal are output as Rout, Gout, and Bout, respectively. In this manner, signal processing may be switched among as many types as the number of the primary colors of the liquid crystal display panel 110.

As may be understood from the comparison between this preferred embodiment (Second preferred embodiment) and Comparative Example 3 in Table 5, in terms of chromaticities at which magenta and cyan are displayed, this preferred embodiment is closer to the conventional liquid crystal display device than Comparative Example 3 is. In terms of luminance, on the other hand, Comparative Example 3 is closer to the conventional liquid crystal display device than this embodiment is. In short, in this preferred embodiment, the optimization of the chromaticity is given priority over luminance optimization by lowering the blue sub-pixel luminance from its original luminance. This way, an image having a natural color tone may be displayed without impairing the color appearance of the original image even in a color gamut in which there are no additional sub-pixels.

In the liquid crystal display device of this preferred embodiment which has an additional yellow sub-pixel, the luminance of the yellow sub-pixel may be set arbitrarily as the need arises as described above, and accordingly the Y value may be increased by setting the luminance of the yellow sub-pixel high.

Figure 22:
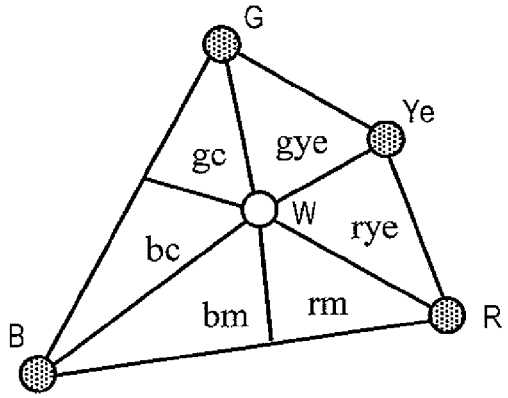
FIG. 22 is a schematic diagram for describing which color is favorably suitable to color tone correction in the liquid crystal display device of the second preferred embodiment of the present invention.

What color is favorably suitable to color tone correction in the liquid crystal display device of this preferred embodiment is described below with reference to FIG. 22. FIG. 22 is a chromaticity diagram showing a schematic reproducible color gamut in the liquid crystal display device of this preferred embodiment. In FIG. 22, R, G, B, and Ye correspond to the red, green, blue, and yellow sub-pixels, and W corresponds to white. This diagram, too, illustrates the chromaticity of white as equal to the chromaticity of black. In FIG. 22, gye represents a range in which the green component and the yellow component are the main components, and r, g, b, ye, c, and m each represents a color component that constitutes one of the main components in a range in question.

The liquid crystal display device of this preferred embodiment has a yellow sub-pixel in addition to the sub-pixels of a common three-primary color liquid crystal display device. Therefore, when a pixel displays a color containing the yellow component, in other words, when a color within the gye and rye ranges illustrated in FIG. 22 is displayed, the luminances of the red sub-pixel and the green sub-pixel may be set lower than their original luminances while the lowered luminances are supplemented by the yellow sub-pixel. The blue sub-pixel luminance in this case may be equal to its original luminance. In other words, when a pixel displays a color that does not contain the yellow component and that contains at least one color component that is other than the yellow component (typically cyan and magenta), the color tone correction circuit 120 (see FIG. 20) may make a correction to set the blue sub-pixel luminance lower than its original luminance. By thus lowering the blue sub-pixel luminance when a color that does not contain the yellow component is displayed, a high color temperature is achieved and the backlight of the display device may be manufactured from a fluorescent material that has excellent luminance efficiency and mass-producibility. As a result, a fine quality image may be displayed at low cost without losing the brightness.

Figure 23:
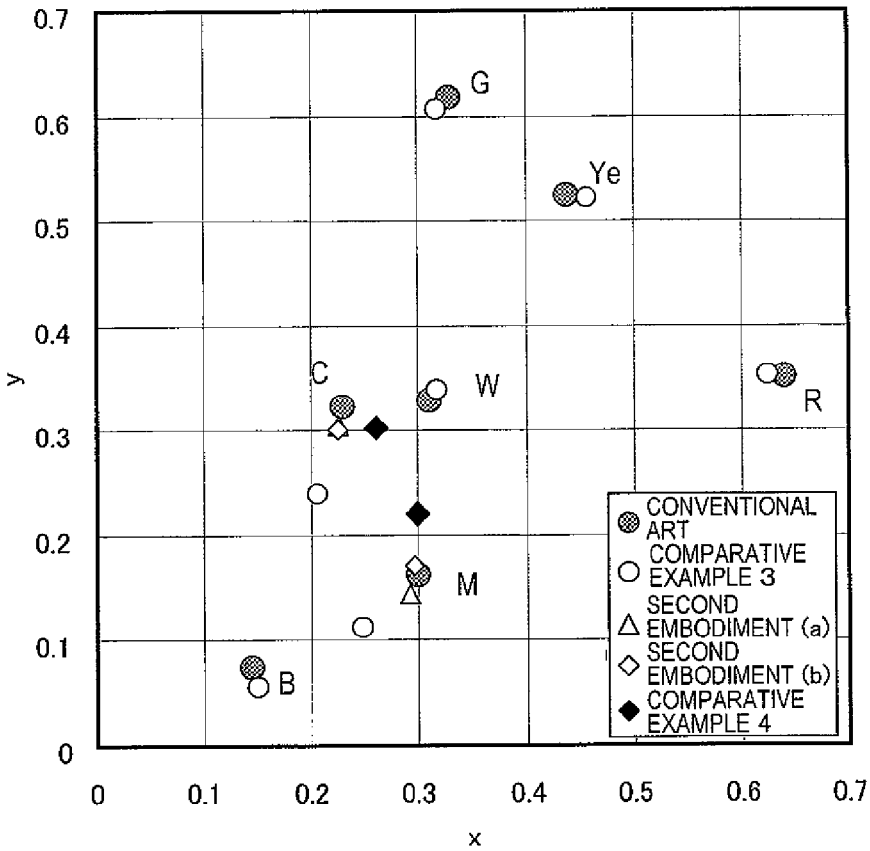
FIG. 23 is a graph illustrating chromaticities of pixel colors in liquid crystal display devices of the conventional art, Comparative Example 3, Comparative Example 4, the second preferred embodiment (a) and the second preferred embodiment (b).

FIG. 23 illustrates chromaticities at which a pixel displays red (R), green (G), blue (B), yellow (Ye), cyan (C), magenta (M), and white (W) in the liquid crystal display devices of the conventional art and Comparative Example 3. FIG. 23 also illustrates chromaticities at which a pixel displays cyan (C) and magenta (M) in liquid crystal display devices of this embodiment (a), this embodiment (b), and Comparative Example 4. "Second embodiment (a)" of FIG. 23 is similar to "second embodiment" shown in FIG. 18 and illustrates the result of setting the blue sub-pixel luminance to 0.7 times the original luminance when a pixel displays magenta and cyan. "Second embodiment (b)" of FIG. 23 illustrates the result of setting the blue sub-pixel luminance to 0.7 times the original luminance and multiplying the luminance of the yellow sub-pixel by 1.1 when a pixel displays magenta and cyan. The liquid crystal display device of "conventional art" of FIG. 23 illustrates the same result that is illustrated by the liquid crystal display device of "conventional art" of FIG. 18. The liquid crystal display device of "Comparative Example 4" of FIG. 23 illustrates the result of multiplying the luminance of the yellow sub-pixel by 1.1 without correcting the blue sub-pixel luminance when a pixel displays magenta and cyan. Table 7 illustrates Y values and chromaticities x, y at which a pixel displays cyan (C) and magenta (M) in the liquid crystal display devices of this embodiment (a) and this embodiment (b).

TABLE 7

| | C | | | M | | |
|---|---|---|---|---|---|---|
| | Y | x | y | Y | x | y |
| this embodiment (a) | 4.85 | 0.2184 | 0.2826 | 1.87 | 0.2895 | 0.1490 |
| this embodiment (b) | 5.51 | 0.2345 | 0.2991 | 2.53 | 0.2911 | 0.1667 |

As may be understood from a comparison between Tables 5 and 7 and from FIG. 23, this embodiment (b) prevents a reduction in sub-pixel area from lowering the Y value and optimizes the pixel luminance by multiplying the luminance of the yellow sub-pixel by 1.1 in addition to setting the blue sub-pixel luminance to 0.7 times the original luminance. This embodiment (b) thus brings the chromaticities of cyan and magenta closer to the cyan and magenta chromaticities in the conventional liquid crystal display device, and a shift in color tone may be suppressed as a result.

As seen from Comparative Example 4 of FIG. 23, increasing the luminance of the yellow sub-pixel without lowering the blue sub-pixel luminance causes a rapid change in chromaticity toward white. It is therefore preferable for the color tone correction circuit 120 to give priority to lowering the blue sub-pixel luminance over increasing the luminance of the yellow sub-pixel.

Third Preferred Embodiment

A liquid crystal display device of a third preferred embodiment according to the present invention is described below with reference to FIGS. 24 to 28. The liquid crystal display device of this preferred embodiment differs from the liquid crystal display device of the second preferred embodiment in that each pixel has a cyan sub-pixel in addition to the red, green, blue, and yellow sub-pixels. The liquid crystal display device of this preferred embodiment preferably has the same structure as that of the above-mentioned liquid crystal display device of the second preferred embodiment, and descriptions on overlapping points are omitted in order to avoid redundancy.

Figure 24:
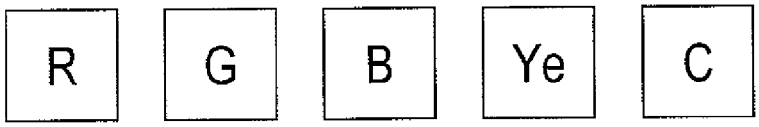
FIG. 24 is a schematic diagram illustrating a single pixel in a liquid crystal display device of a third preferred embodiment according to the present invention.
Figure 25:
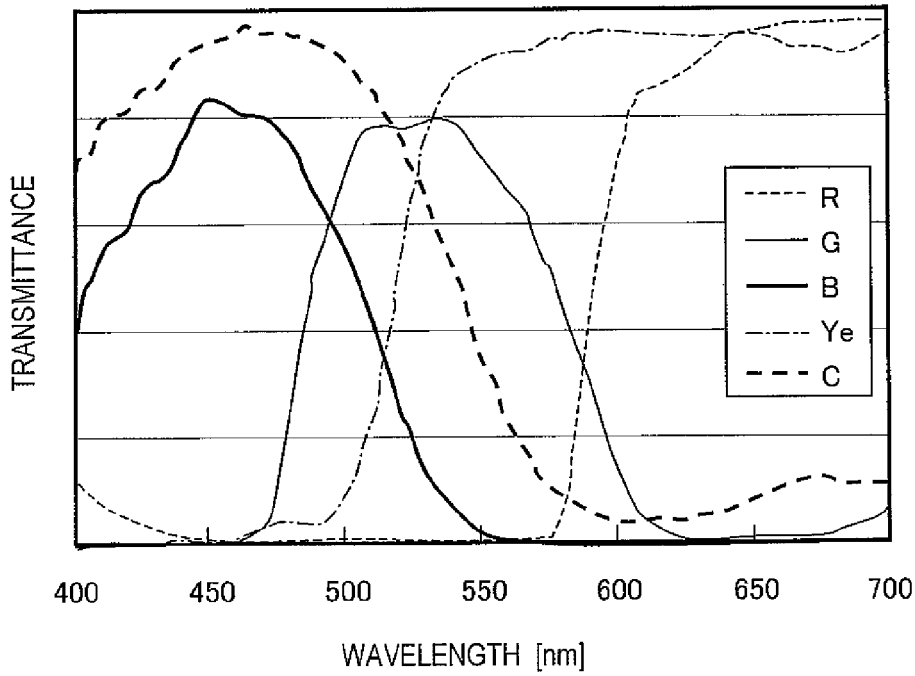
FIG. 25 is a graph illustrating transmittances of color filter elements which correspond to sub-pixels in the liquid crystal display device of the third preferred embodiment of the present invention.

FIG. 24 illustrates five sub-pixels that are contained within a single pixel in a liquid crystal display device 100 of this preferred embodiment, namely, red (R), green (G), blue (B), yellow (Ye), and cyan (C) sub-pixels. FIG. 25 illustrates transmittances of color filter elements which correspond to the sub-pixels in the liquid crystal display device 100 of this preferred embodiment. In FIG. 25, C represents a transmittance at which the color filter element of the cyan sub-pixel transmits light of varying wavelengths. R, G, B, and Ye represent transmittances at which the color filter elements of the red, green, blue, and yellow sub-pixels transmit light of varying wavelengths, and the transmittances of FIG. 25 are the same as the color filter transmittances of varying wavelengths in the red, green, blue, and yellow sub-pixels which have been described with reference to FIG. 16.

In the liquid crystal display device of this preferred embodiment, too, as in the second preferred embodiment, owing to the inclusion of the yellow sub-pixel in a pixel, a color displayed by a pixel gives a yellowish overtone and lowers the color temperature. The liquid crystal display device of this preferred embodiment therefore achieves a predetermined color temperature by using a high color temperature backlight.

Figure 26:
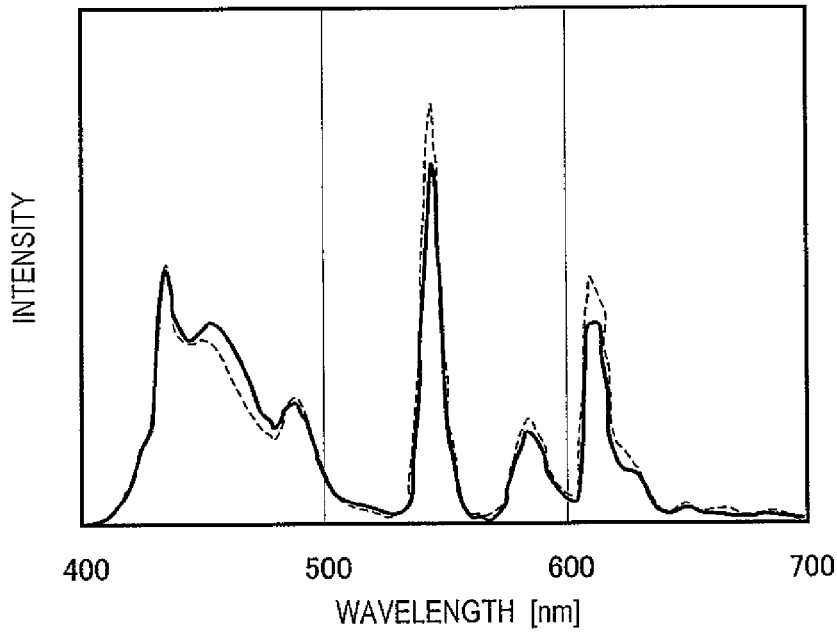
FIG. 26 is a graph illustrating spectra of backlights in a conventional liquid crystal display device and the liquid crystal display device of the third preferred embodiment of the present invention.

FIG. 26 illustrates the spectra of backlights in the liquid crystal display device of this preferred embodiment and a three-primary color liquid crystal display device. The backlights used here are cold cathode fluorescent lamps (CCFLs). In FIG. 26, the spectrum of the CCFL in the liquid crystal display device of this preferred embodiment is illustrated in solid line, and the spectrum of the CCFL used as the backlight in the three-primary color liquid crystal display device is illustrated in broken line. The three-primary color CCFL is fabricated so as to suit RGB three-primary color liquid crystal display devices. As is understood from FIG. 26, the spectrum of the CCFL in this embodiment is such that the intensity at a wavelength corresponding to blue is higher than the one in the three-primary color CCFL, whereas the intensities at wavelengths corresponding to red and green are lower than the ones in the three-primary color CCFL.

Figure 27:
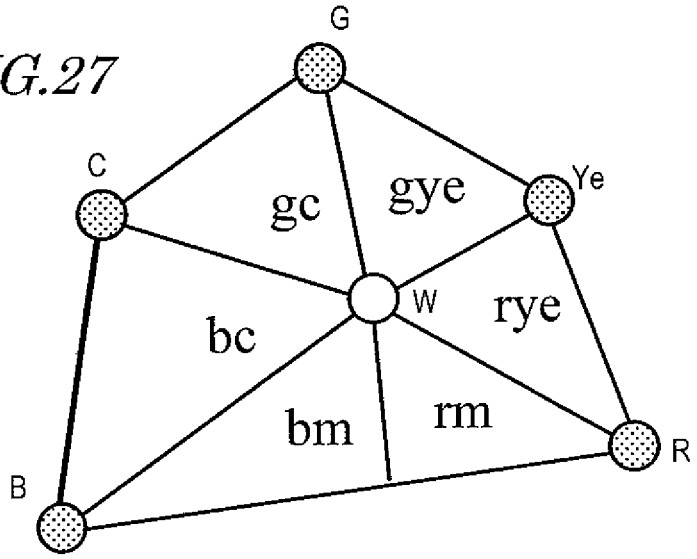
FIG. 27 is a schematic diagram for describing which color is favorably suitable to color tone correction in the liquid crystal display device of the third preferred embodiment of the present invention.

What color is favorably suitable to color tone correction in the liquid crystal display device of this preferred embodiment is described below with reference to FIG. 27. FIG. 27 is a chromaticity diagram showing a schematic reproducible color gamut in the liquid crystal display device of this preferred embodiment.

The liquid crystal display device of this preferred embodiment has a yellow sub-pixel and a cyan sub-pixel in addition to the sub-pixels of a common three-primary color liquid crystal display device. Therefore, when a color within the gye and rye ranges illustrated in FIG. 27 is displayed, the luminances of the red sub-pixel and the green sub-pixel may be set lower than their original luminances while the lowered luminances are supplemented by the yellow sub-pixel, and when a color within the be and gc ranges illustrated in FIG. 27 is displayed, the luminances of the blue sub-pixel and the green sub-pixel may be set lower than their original luminances while the lowered luminances are supplemented by the cyan sub-pixel. The blue sub-pixel luminance in this case may be equal to its original luminance. In other words, when a pixel displays a color that does not contain the yellow component and the cyan component and that contains at least one color component that is other than the yellow component and the cyan component (typically magenta), the color tone correction circuit 120 (see FIG. 20) may make a correction to set the blue sub-pixel luminance lower than its original luminance. By thus lowering the blue sub-pixel luminance when a color that does not contain the yellow component is displayed, a high color temperature is achieved and the backlight of the display device may be manufactured from a fluorescent material that has excellent luminance efficiency and mass-producibility. As a result, a fine quality image may be displayed at low cost without losing the brightness.

Figure 28:
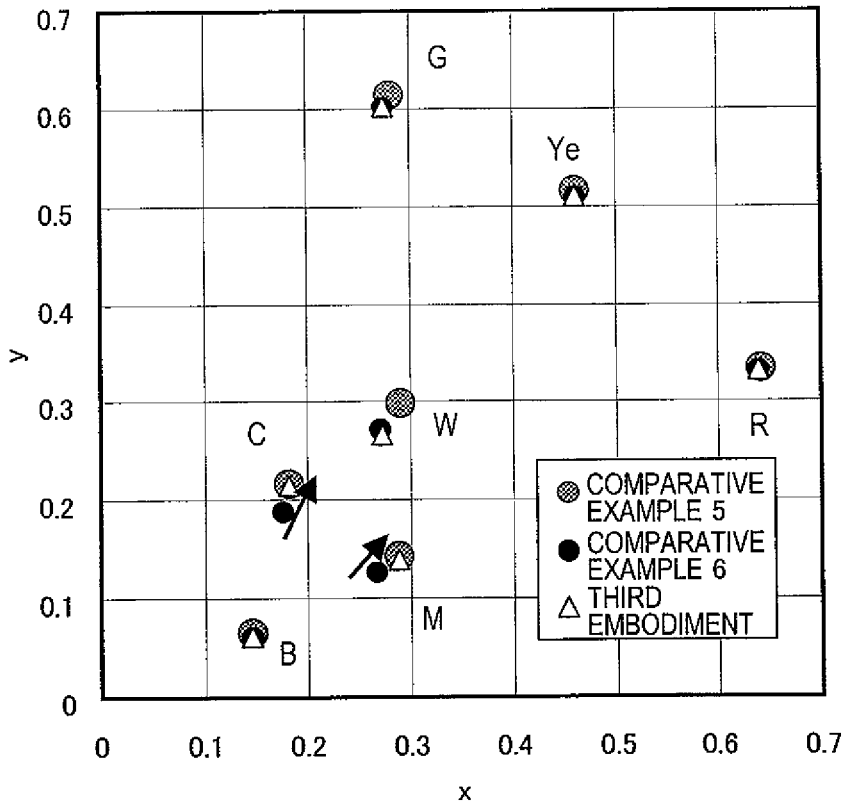
FIG. 28 is a graph illustrating chromaticities at which a pixel displays red (R), green (G), blue (B), yellow (Ye), cyan (C), magenta (M), and white (W) in liquid crystal display devices of Comparative Examples 5 and 6 and the third preferred embodiment of the present invention.

FIG. 28 illustrates chromaticities at which a pixel displays red (R), green (G), blue (B), yellow (Ye), cyan (C), magenta (M), and white (W) in liquid crystal display devices of Comparative Examples 5 and 6, and this preferred embodiment. The liquid crystal display device of Comparative Example 5 differs from the liquid crystal display device of this preferred embodiment in that the blue sub-pixel luminance is not corrected and that a three-primary color CCFL is used as a backlight. The liquid crystal display device of Comparative Example 6 differs from the liquid crystal display device of this preferred embodiment in that the blue sub-pixel luminance is not corrected. Note that the liquid crystal display device of this preferred embodiment sets the blue sub-pixel luminance to 0.5 times the original luminance when the pixel displays cyan and to 0.8 times the original luminance when the pixel displays magenta. Table 8 illustrates Y values and chromaticities x, y at which a pixel displays cyan (C) and magenta (M) in the liquid crystal display devices of the conventional art, Comparative Example 6, and this preferred embodiment. The liquid crystal display device of "conventional art" in Table 8 illustrates the results of using a three-primary color CCFL as a backlight in a conventional three-primary color liquid crystal display device.

TABLE 8

| | C | | | M | | |
|---|---|---|---|---|---|---|
| | Y | x | y | Y | x | y |
| Conventional art | 6.72 | 0.1935 | 0.2620 | 3.27 | 0.2888 | 0.1417 |
| Comparative Example 6 | 6.55 | 0.1747 | 0.1880 | 2.09 | 0.2658 | 0.1276 |
| Third embodiment | 6.17 | 0.1811 | 0.2152 | 1.94 | 0.2873 | 0.1394 |

As illustrated in FIG. 28, the chromaticity of white in the liquid crystal display device of Comparative Example 6 is shifted in the blue direction from the chromaticity of white in the liquid crystal display device of Comparative Example 5, and the color temperature is higher in the liquid crystal display device of Comparative Example 6 than in the liquid crystal display device of Comparative Example 5. This is because the liquid crystal display device of Comparative Example 6 uses a high color temperature backlight. However, the chromaticities of cyan and magenta in the liquid crystal display device of Comparative Example 6 are shifted in the blue direction from the ones in the liquid crystal display device of Comparative Example 5, thereby causing a shift from the color tone of the liquid crystal display device of Comparative Example 5.

In contrast, since the liquid crystal display device of this preferred embodiment sets the blue sub-pixel luminance to 0.5 times and 0.8 times the original luminance when a pixel displays cyan and magenta, respectively, the liquid crystal display device may have approximately the same cyan and magenta chromaticities as those in the liquid crystal display device of Comparative Example 5, despite the use of a high color temperature backlight.

The color temperature in the liquid crystal display device of this preferred embodiment is 12,700 K, which is higher than the color temperature (8,600 K) in the liquid crystal display device of Comparative Example 5, as illustrated in Table 9. Also, the liquid crystal display device of this preferred embodiment has yellow and cyan sub-pixels in each pixel in addition to red, green, and blue sub-pixels, and has a higher NTSC ratio than those of the first preferred embodiment and the second preferred embodiment which are illustrated in Tables 3 and 6.

TABLE 9

| | NTSC ratio | Color temperature |
|---|---|---|
| Comparative Example 5 | 79% | 8,600 K |
| Third embodiment | 80% | 12,700 K |

As in the liquid crystal display device of the second preferred embodiment described with reference to FIG. 21, the color tone correction circuit 120 in the liquid crystal display device 100 of this preferred embodiment creates a corrected image signal that indicates the luminances of the sub-pixels of five primary colors from an image signal that indicates the original luminances of the sub-pixels of three primary colors.

In the description above, the blue sub-pixel luminance set when a pixel displays cyan is 0.5 times the original luminance, and the blue sub-pixel luminance set when a pixel displays magenta is 0.8 times the original luminance, but the present invention is not limited thereto. The ratio of the blue sub-pixel luminance set when a pixel displays cyan to the original luminance may be equal to the ratio of the blue sub-pixel luminance set when a pixel displays magenta to the original luminance. However, the ratio of the blue sub-pixel luminance set when a pixel displays magenta is preferably smaller than the ratio of the blue sub-pixel luminance set when a pixel displays cyan because, while the presence of the cyan sub-pixels enables the liquid crystal display device of this preferred embodiment to achieve an appropriate color appearance by increasing the luminance of the cyan sub-pixel despite the lowered blue sub-pixel luminance, the liquid crystal display device of this preferred embodiment does not have a magenta sub-pixel.

Figure 29:
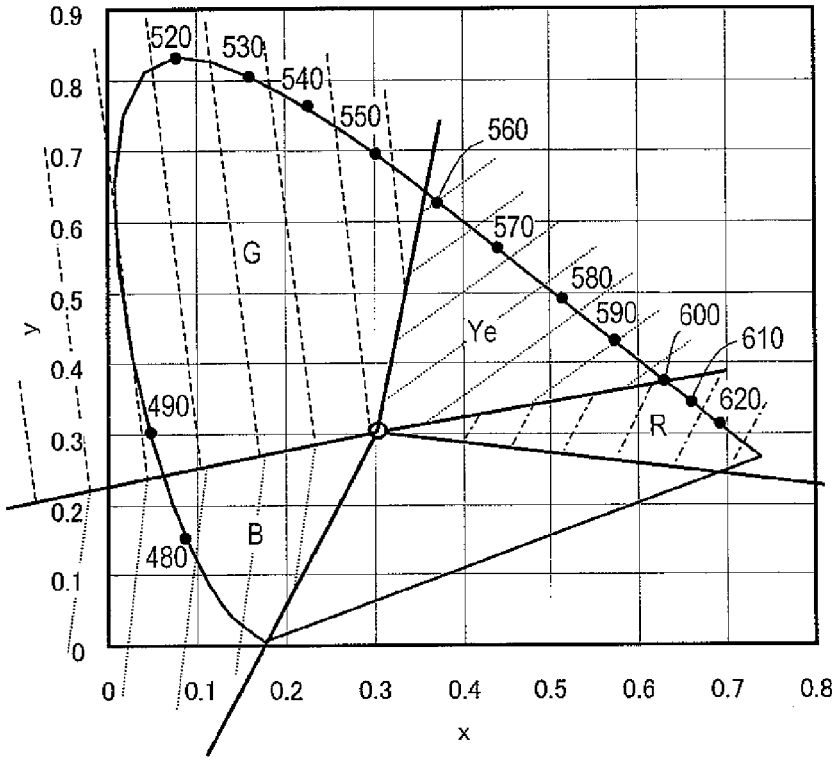
FIG. 29 is a chromaticity diagram illustrating the chromaticities of sub-pixels in the liquid crystal display devices of the first preferred embodiment and the second preferred embodiment of the present invention.
Figure 30:
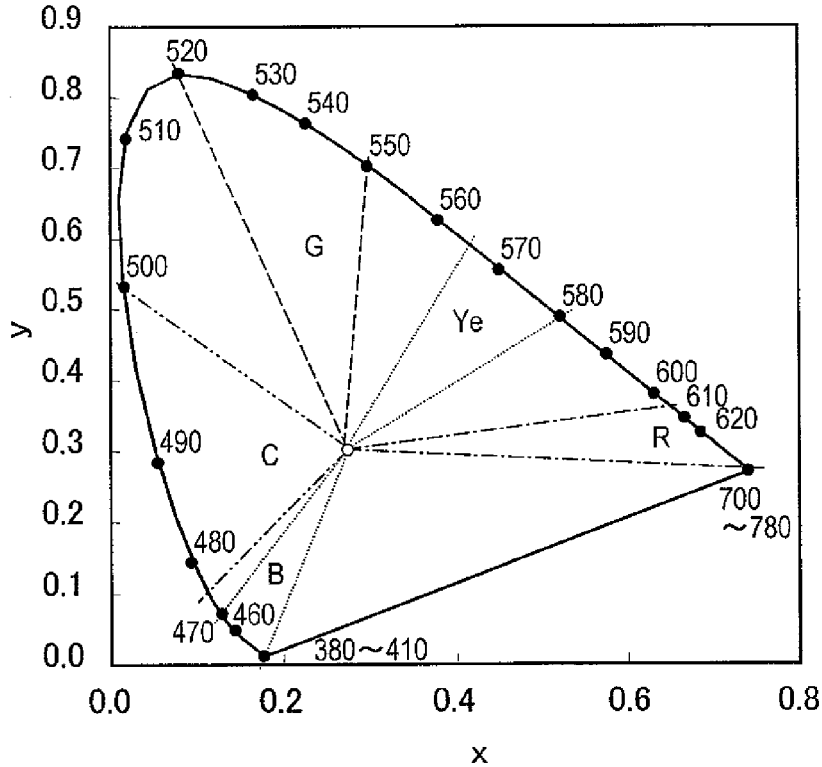
FIG. 30 is a chromaticity diagram illustrating the chromaticities of sub-pixels in the liquid crystal display device of the third preferred embodiment of the present invention.

FIGS. 29 and 30 illustrate the spectrum locus and the dominant wavelength. As illustrated in FIG. 29, in the liquid crystal display devices of the first preferred embodiment and the second embodiment, a sub-pixel whose dominant wavelength is 597 nm to less than 780 nm is called a red sub-pixel, a sub-pixel whose dominant wavelength is 558 nm to less than 597 nm is called a yellow sub-pixel, a sub-pixel whose dominant wavelength is 488 nm to less than 558 nm is called a green sub-pixel, and a sub-pixel whose dominant wavelength is 380 nm to less than 488 nm is called a blue sub-pixel.

As illustrated in FIG. 30, in the liquid crystal display device of the third preferred embodiment, a sub-pixel whose dominant wavelength is 605 nm to less than 635 nm is called a red sub-pixel, a sub-pixel whose dominant wavelength is 565 nm to less than 580 nm is called a yellow sub-pixel, a sub-pixel whose dominant wavelength is 520 nm to less than 550 nm is called a green sub-pixel, a sub-pixel whose dominant wavelength is 475 nm to less than 500 nm is called a cyan sub-pixel, and a sub-pixel whose dominant wavelength is less than 470 nm is called a blue sub-pixel. A comparison between FIG. 29 and FIG. 30 illustrates that the range of the dominant wavelength corresponding to the cyan sub-pixel in the third preferred embodiment partially overlaps with the range of the dominant wavelength corresponding to the green sub-pixel in the first preferred embodiment and the second preferred embodiment.

The function blocks that the color tone correction circuit 120 has in the liquid crystal display devices 100 of the above-mentioned first to third preferred embodiments, specifically, the inverse γ correction processing unit 121, the color component extracting unit 122, the signal synthesizing unit 123, the clipping processing unit 124, and the γ correction processing unit 125, may be implemented by hardware. Alternatively, some of or all of those functional blocks may be implemented by software.

In the case where the above-mentioned function blocks are implemented by software, the color tone correction circuit 120 is configured with the use of a computer. This computer has a central processing unit (CPU) for executing various programs, a random access memory (RAM) functioning as a workspace in which those programs are executed, and others. A color tone correction program for implementing the above-mentioned function block is run on the above-mentioned computer, to thereby cause the computer to operate as the function blocks.

The color tone correction program may be supplied to the computer from a recording medium in which the program is recorded, or may be supplied to the computer over a communication network. The recording medium in which the color tone correction program is recorded may be detachable from the computer, or may be incorporated in the computer. This recording medium may be of a type that is loaded to the computer so that the computer may directly read a recorded program code, or a type that is loaded to be read via a program reading device, which is connected to the computer as external storage.

Examples of a medium that is employable as the above-mentioned recording medium include tape type media such as magnetic tapes and cassette tapes, disk type media such as magnetic disks (e.g., flexible disks and hard disks) and optical disks (e.g., CD-ROMs, MOs, MDs, DVDs, CD-Rs), card type media such as IC cards (including memory cards) and optical cards, and semiconductor memories such as mask ROMs, erasable programmable read only memories (EPROMs), electrically erasable programmable read only memories (EEPORMs), and Flash ROMs.

In the case where the above-mentioned color tone correction program is preferably supplied over a communication network, the color tone correction program takes the form of a carrier wave or a data signal string in which a program code of the color tone correction program is embodied through electronic transfer.

The liquid crystal display device of this preferred embodiment preferably uses five primary colors but the present invention is not limited thereto. The liquid crystal display device may use six primary colors, which are, for example, RGBYeCM, or may be R1GBYeCR2 by the use of red (R2) instead of magenta (M). In this case, R1 and R2 may have the same chromaticity or different chromaticities.

A liquid crystal display device according to various preferred embodiments of the present invention is favorably applied to, for example, monitors for personal computers, liquid crystal television sets, liquid crystal projectors, and display sections of cellular phones.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A liquid crystal display device, comprising:

a liquid crystal display panel which includes a pixel defined by at least three sub-pixels including a blue sub-pixel;

a backlight arranged to emit, toward the liquid crystal display panel, light that brings a color temperature to a predetermined level when the pixel displays white; and a color tone correction section arranged to correct a color tone of a color displayed by the pixel; wherein when the pixel displays a color containing at least one predetermined color component that is other than a white component and a blue component, the color tone correction section makes a correction to set a luminance of the blue sub-pixel lower than an original luminance; and the luminance of the blue sub-pixel remains uncorrected whenever the color displayed by the pixel includes only the white component.

2. The liquid crystal display device according to claim 1, wherein the at least one predetermined color component is a magenta component or a cyan component.

3. The liquid crystal display device according to claim 1, wherein, when the pixel displays a color that contains only the blue component, or a color that contains only the white component and the blue component, the color tone correction section makes a correction to set the luminance of the blue sub-pixel lower than the original luminance.

4. The liquid crystal display device according to claim 1, wherein, when the pixel displays a color that contains only the blue component, or a color that contains only the white component and the blue component, the color tone correction section does not make a correction on the luminance of the blue sub-pixel and the luminance of the blue sub-pixel is equal to the original luminance.

5. The liquid crystal display device according to claim 1, wherein a maximum luminance of the blue sub-pixel that is set when the pixel displays an arbitrary color containing the at least one predetermined color component is lower than the luminance of the blue sub-pixel that is set when the pixel displays at least one of white and blue.

6. The liquid crystal display device according to claim 1, wherein the color tone correction section creates a corrected image signal that indicates luminances to be actually presented by the at least three sub-pixels, from an image signal that indicates original luminances of a red sub-pixel, a green sub-pixel, and the blue sub-pixel in a pixel that is formed only of the red sub-pixel, the green sub-pixel, and the blue sub-pixel.

7. The liquid crystal display device according to claim 6, wherein the color tone correction section includes:

a color component extracting unit arranged to extract a color component from a color of the pixel that is indicated by the image signal; and a signal synthesizing unit which is arranged to create, based on the original luminance of the blue sub-pixel and the color component, the corrected image signal in a manner that makes the luminance to be actually presented by the blue sub-pixel lower than the original luminance.

8. The liquid crystal display device according to claim 1, wherein the at least three sub-pixels include a red sub-pixel and a green sub-pixel.

9. The liquid crystal display device according to claim 8, wherein the at least three sub-pixels further include a yellow sub-pixel.

10. The liquid crystal display device according to claim 9, wherein the color tone correction section sets a luminance of the yellow sub-pixel to a predetermined value.

11. The liquid crystal display device according to claim 8, wherein, when the pixel displays a color which is free of a yellow component and which contains at least one color component other than the yellow component, the color tone correction section makes a correction to set the luminance of the blue sub-pixel lower than the original luminance.

12. The liquid crystal display device according to claim 9, wherein the at least three sub-pixels further include a cyan sub-pixel.

13. The liquid crystal display device according to claim 12, wherein, when the pixel displays a color which is free of the yellow component and a cyan component and which contains at least one color component other than the yellow component and the cyan component, the color tone correction section makes a correction to set the luminance of the blue sub-pixel lower than the original luminance.

14. A liquid crystal display device comprising a pixel that is defined by at least three sub-pixels including a blue sub-pixel, wherein a maximum luminance of the blue sub-pixel that is set when the pixel displays an arbitrary color containing at least one predetermined color component that is other than a white component and a blue component is lower than a luminance of the blue sub-pixel that is set when the pixel displays at least one of white and blue;

the luminance of the blue sub-pixel is corrected when the pixel displays a color containing the at least one predetermined color component that is other than the white component and the blue component; and the luminance of the blue sub-pixel remains uncorrected whenever the color displayed by the pixel includes only the white component.

15. The liquid crystal display device according to claim 14, wherein the at least one predetermined color component is a magenta component or a cyan component.

16. The liquid crystal display device according to claim 14, wherein the at least three sub-pixels include a red sub-pixel and a green sub-pixel.

17. The liquid crystal display device according to claim 16, wherein the at least three sub-pixels further include a yellow sub-pixel.

18. The liquid crystal display device according to claim 17, wherein the at least three sub-pixels further include a cyan sub-pixel.

19. A liquid crystal display device comprising a pixel containing a red sub-pixel, a green sub-pixel, and a blue sub-pixel, wherein a luminance of the blue sub-pixel that is set when the pixel displays magenta and a luminance of the blue sub-pixel that is set when the pixel displays cyan are lower than a luminance of the blue sub-pixel that is set when the pixel displays white;

the luminance of the blue sub-pixel is corrected when the pixel displays a color containing at least one predetermined color component that is other than a white component and a blue component; and the luminance of the blue sub-pixel remains uncorrected whenever the color displayed by the pixel includes only the white component.

20. The liquid crystal display device according to claim 19, wherein the pixel further includes a yellow sub-pixel.

21. The liquid crystal display device according to claim 20, wherein the pixel further includes a cyan sub-pixel.

* * * * *